US010273602B2

(12) United States Patent
Sakaue et al.

(10) Patent No.: US 10,273,602 B2
(45) Date of Patent: Apr. 30, 2019

(54) METHOD FOR MANUFACTURING WOVEN FABRIC AND WOVEN FABRIC

(71) Applicant: Sakaue Weaving Co., Ltd., Osaka (JP)

(72) Inventors: Motohiko Sakaue, Osaka (JP); Mituo Ogata, Osaka (JP); Hajime Shimoide, Osaka (JP)

(73) Assignee: SAKAUE WEAVING CO., LTD., Osaka (JP)

( * ) Notice: Subject to any disclaimer, the term of this patent is extended or adjusted under 35 U.S.C. 154(b) by 624 days.

(21) Appl. No.: 14/786,918

(22) PCT Filed: Mar. 24, 2015

(86) PCT No.: PCT/JP2015/058871
§ 371 (c)(1),
(2) Date: Oct. 23, 2015

(87) PCT Pub. No.: WO2015/166748
PCT Pub. Date: Nov. 5, 2015

(65) Prior Publication Data

US 2016/0076174 A1 Mar. 17, 2016

(30) Foreign Application Priority Data

Apr. 30, 2014 (WO) ..... PCT/JP2014/061990

(51) Int. Cl.
*D03D 15/08* (2006.01)
*D03D 23/00* (2006.01)
(Continued)

(52) U.S. Cl.
CPC ..... *D03D 15/08* (2013.01); *D03C 9/024* (2013.01); *D03D 11/02* (2013.01); *D03D 13/00* (2013.01);
(Continued)

(58) Field of Classification Search
CPC .... D03D 15/08; D03D 13/00; D03D 15/0083; D03D 15/0088; D03D 41/008;
(Continued)

(56) References Cited

U.S. PATENT DOCUMENTS 5,699,836 A 12/1997 Golz
2005/0085147 A1* 4/2005 Homma ..... B29C 70/22 442/218
(Continued)

FOREIGN PATENT DOCUMENTS

CN 1679120 A 10/2005
DE 197 31 260 C1 8/1998
(Continued)

OTHER PUBLICATIONS

Office Action issued in Chinese Patent Application No. 201580020205.9, dated Jun. 20, 2017.
(Continued)

*Primary Examiner* — Shaun R Hurley
*Assistant Examiner* — Andrew Wayne Sutton
(74) *Attorney, Agent, or Firm* — Michael Best & Friedrich LLP

(57) ABSTRACT

To provide a method for manufacturing a woven fabric for which neither the appearance nor a function provided by flat threads of the woven fabric are impaired, and to provide the woven fabric.
The woven fabric further includes flat threads 3 each wider than a fiber warp thread 10, and the flat threads 3 are caused to pass through healds 102 intermittently with respect to a plurality of the fiber warp threads 10. A hole 102*a* of each heald is long in a heald moving direction. By causing the flat thread 3 to pass through the hole, the longitudinal direction in transverse plane of the flat thread 3 is oriented along a heald moving direction M. By interweaving fiber weft
(Continued)

threads with the fiber warp threads 10, a plurality of woven fabric placement sections is formed so as to be arranged in a weft direction W, each woven fabric placement section being formed as a woven fabric structure and having the flat thread corresponding thereto placed on the woven fabric structure. A flat face HF of the flat thread 3 is disposed on the fiber warp threads 10 in the woven fabric placement section so as to face the fiber warp threads 10. A part of the fiber weft threads is caused to pass over the flat thread 3, to fix the flat thread 3 on the woven fabric placement section. The woven fabric covering section may be formed as a plain weave.

19 Claims, 37 Drawing Sheets

(51) Int. Cl.

| | |
|---|---|
| ***D03C 9/02*** | (2006.01) |
| ***D03D 13/00*** | (2006.01) |
| ***D03D 15/00*** | (2006.01) |
| ***D03D 41/00*** | (2006.01) |
| ***D03D 49/62*** | (2006.01) |
| ***D03D 11/02*** | (2006.01) |

(52) U.S. Cl.
CPC ..... *D03D 15/0088* (2013.01); *D03D 23/00* (2013.01); *D03D 41/008* (2013.01); *D03D 49/62* (2013.01); *D10B 2401/16* (2013.01); *D10B 2401/20* (2013.01)

(58) Field of Classification Search
CPC .... D03D 49/62; D03C 9/024; D10B 2401/16; D10B 2401/20
See application file for complete search history.

(56) References Cited

U.S. PATENT DOCUMENTS

| | | | | |
|---|---|---|---|---|
| 2009/0007981 | A1 | 1/2009 | Khokar | |
| 2009/0134685 | A1* | 5/2009 | Schwartz | D02G 3/346 297/451.9 |
| 2010/0291824 | A1* | 11/2010 | Roemer | D03D 13/004 442/246 |

FOREIGN PATENT DOCUMENTS

| | | | |
|---|---|---|---|
| DE | 10 200 6046349 | A1 | 4/2008 |
| EP | 2995706 | * | 3/2016 |
| JP | 1926024833 | Y | 4/1926 |
| JP | H06-264387 | A | 9/1994 |
| JP | 2005-054292 | A | 3/2005 |
| JP | 3 114 116 | U | 9/2005 |
| JP | 3114116 | U | 9/2005 |

OTHER PUBLICATIONS

Extended Search Report issued in European Patent Application No. 15786458.8, dated May 24, 2017.

* cited by examiner

FIG.1
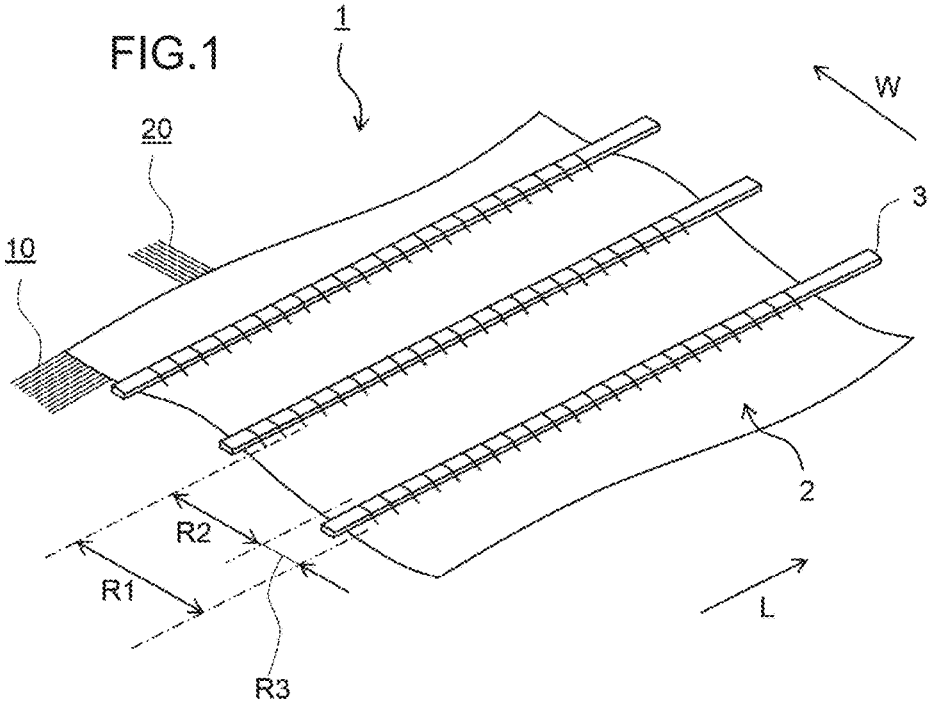
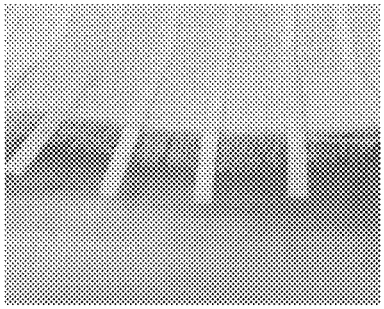
FIG.2

METHOD FOR MANUFACTURING WOVEN FABRIC AND WOVEN FABRIC

TECHNICAL FIELD

The present invention relates to a method for manufacturing a woven fabric which includes fiber warp threads and fiber weft threads, and which further includes flat threads that are each wider than each fiber warp thread. The present invention also relates to the woven fabric.

BACKGROUND ART

By providing the flat thread with flexibility or other functions, the woven fabric as mentioned above is expected to exhibit a function of being deformable itself or the like. However, such a woven fabric has not existed. In the case of the woven fabric as in PATENT DOCUMENT 1, if a flat thread is used instead of a thick monofilament, the flat thread is not placed on a woven fabric placement section. In addition, as a basic characteristic of a woven fabric, the weft threads tend to curve into a protruding shape on the center portion side because the center portion in the width direction of the woven fabric is shorter than the lateral sides of the woven fabric. Therefore, for example, if the flat thread has flexibility of a level that allows deformation of the woven fabric to be maintained, the flexible flat thread curves as a weft thread in the direction along the flat face, which may cause problem in the function of the woven fabric.

CITATION LIST

Patent Documents

[PATENT DOCUMENT 1] Japanese Laid-Open Patent Publication No. 2005-54292

SUMMARY OF THE INVENTION

Problems to be Solved by the Invention

In view of such conventional circumstances, an object of the present invention is to provide a method for manufacturing a woven fabric for which neither the appearance nor the function provided by the flat threads of the woven fabric are impaired, and to provide the woven fabric.

Solution to the Problems

In order to attain the above object, a first feature of a method for manufacturing a woven fabric according to the present invention is as follows: the woven fabric includes fiber warp threads and fiber weft threads, and further includes flat threads each wider than each fiber warp thread, and the method includes: causing the flat threads to pass through healds intermittently with respect to a plurality of the fiber warp threads; causing each flat thread to pass through a hole of the heald corresponding thereto, the hole being long in a heald moving direction, thereby to orient a longitudinal direction in transverse plane of the flat thread along the heald moving direction; interweaving the fiber weft threads with the fiber warp threads to form a plurality of woven fabric placement sections so as to be arranged in a weft direction, each woven fabric placement section being formed as a woven fabric structure and having the flat thread corresponding thereto placed on the woven fabric structure; disposing a flat face of the flat thread on the fiber warp threads in the woven fabric placement section so as to face the fiber warp threads; and causing a part of the fiber weft threads to pass over the flat thread, to fix the flat thread on the woven fabric placement section.

According to the feature of the method for manufacturing the woven fabric, flat threads are caused to pass through healds intermittently with respect to a plurality of the fiber warp threads, and each flat thread is caused to pass through a hole of the heald corresponding thereto, the hole being long in the heald moving direction. Thus, even in the case of a wide flat thread, such flat thread does not take a large proportion of the breadth of the healds or the reed. As a result, the fiber warp threads are prevented from getting crowded and rubbing each other, or the fiber warp threads and the flat threads are prevented from getting crowded and rubbing each other. Furthermore, without reducing the density of the warp threads, the woven fabric placement section can be a woven fabric structure so as not to be different from other parts, by use of the warp threads and the weft threads.

Since each flat thread is oriented along the warp direction, the flat thread is not likely to be curved in a direction along the flat face because of the characteristic of a woven fabric described above. Moreover, the woven fabric placement section on which the flat thread is fixed forms a woven fabric structure with the warp threads and the weft threads, which does not impair the appearance. In addition, the flat thread does not run over and under the weft threads frequently, and thus, is not deformed in the direction perpendicular to the flat face. Thus, without being bent, the flat thread is fixed on the woven fabric placement section that has been woven.

On the other hand, in order to attain the above object, a second feature of the method for manufacturing the woven fabric according to the present invention is as follows: the woven fabric includes fiber warp threads and fiber weft threads, and further includes flat threads each wider than each fiber warp thread, and the method includes: causing the flat threads to pass through healds intermittently with respect to a plurality of the fiber warp threads; causing each flat thread to pass through a hole of the heald corresponding thereto, the hole being long in a heald moving direction, thereby to orient a longitudinal direction in transverse plane of the flat thread along the heald moving direction; interweaving the fiber weft threads with the fiber warp threads to form a plurality of woven fabric placement sections so as to be arranged in a weft direction, each woven fabric placement section being formed as a woven fabric structure and having the flat thread corresponding thereto placed on the woven fabric structure; disposing a flat face of the flat thread on the fiber warp threads in the woven fabric placement section so as to face the fiber warp threads; disposing a part of the fiber warp threads on the flat thread; and interweaving a part of the fiber weft threads with a part of the fiber warp threads to form a woven fabric covering section as the woven fabric structure, and fixing the flat thread on the woven fabric placement section by means of the woven fabric covering section.

The second feature is different from the first feature in the "woven fabric covering section". Accordingly, the flat thread is hidden on both the front and rear sides of the woven fabric, and the good appearance of the woven fabric is maintained.

In the above features, adjacent two dents among dents forming a reed may be intermittently cut off at a plurality of positions; obtained adjacent two thin plates may be disposed so as to be shifted to a warp thread winding side, at each position where the two thin plates have been cut off; and the flat thread may be caused to pass between the two thin plates. In this case, the two thin plates may be back dents which form a part of the reed and which are disposed so as to be shifted to the warp thread winding side. In contrast, the two thin plates may be disposed independently of the reed.

The woven fabric manufactured by the method for manufacturing the woven fabric described above has excellent features described above.

On the other hand, in order to attain the above object, a first feature of a woven fabric according to the present invention is as follows: a woven fabric further includes: flat threads each being five or more times wider than each fiber warp thread; and a plurality of woven fabric placement sections arranged in a weft direction, each woven fabric placement section being formed as a woven fabric structure and having the flat thread corresponding thereto placed on the woven fabric structure by the fiber weft threads being interwoven with the fiber warp threads, and in the woven fabric, the flat threads are oriented along a warp direction and arranged in a weft direction, and are each disposed on the fiber warp threads with a flat face of the flat thread facing the fiber warp threads, the woven fabric placement section is a plain weave, and among the fiber warp threads and the fiber weft threads, a part of only the fiber weft threads is caused to pass over each flat thread, to fix the flat thread on the woven fabric placement section.

The woven fabric having this feature exhibits the effects of a woven fabric manufactured according to the first feature of the method for manufacturing of the woven fabric. Further, since the woven fabric placement section is a plain weave, the woven fabric placement section is dense although being light in weight. Thus, the flat thread can be efficiently hidden, and durability (abrasion resistance) can be enhanced. Further, even though the flat thread is laid on the woven fabric placement section, the lengths of floated portions of the threads are small because the woven fabric placement section is a plain weave. Accordingly, the texture is tight and can be made thin.

In the first feature of the woven fabric according to the present invention, the woven fabric may further include: a woven fabric connection section which is woven with the fiber warp threads and the fiber weft threads, and which is disposed between the plurality of woven fabric placement sections to connect the woven fabric placement sections, and the woven fabric connection section may be a plain weave.

According to this feature, the woven fabric connection section is also a plain weave as in the case of the woven fabric placement section. Thus, similarly to the above, the woven fabric connection section is light in weight and the flat thread can be hidden. Since the lengths of floated portions of the threads are small, the texture is tight and can be made thin, and durability (abrasion resistance) can be enhanced. In addition, since both the woven fabric placement section and the woven fabric connection section are plain weaves, and the flat thread is partially fixed with the weft threads, plain weaves having different mesh sizes continue. Since the same structure continues, compared with a case where different structures are combined, design/physical property can be made more uniform.

In the first feature of the woven fabric, the woven fabric may further include: a woven fabric connection section which is woven with the fiber warp threads and the fiber weft threads, and which is disposed between the plurality of woven fabric placement sections to connect the woven fabric placement sections, and the woven fabric connection section may be a combination weave.

According to this feature of the woven fabric, the woven fabric placement section is formed as a plain weave to be thin, has the flat thread laid thereon, and thus has an increased thickness, and the woven fabric connection section is a combination weave and thus has an increased thickness. Therefore, undesired thicknesses of these sections can be balanced with each other.

In the present invention, in addition to the features above, the fiber warp threads and the fiber weft threads may be each not less than 10 denier and not greater than 4000 denier. Moreover, the woven fabric placement section may have a weft density of not less than 8 threads/inch and not greater than 500 threads/inch.

As the flat thread, a body having a rectangular cross section or a flat cable made of synthetic resin can be used. Further, the flat thread may be formed from any one of polyolefin, polycarbonate, polyamide, polyphenylene sulfide, polyetherimide, polyether ketone, polyamide-imide, polypropylene, and ABS. Preferably, the fiber warp threads and the fiber weft threads may be each a natural fiber or a fiber made of synthetic resin.

Advantageous Effects of the Invention

According to the features of the woven fabric and the method for manufacturing the woven fabric according to the present invention, curve in the direction along the flat face and deformation in the direction perpendicular to the flat face are less likely to occur. Thus, the function of the flat thread is maintained. Moreover, the woven fabric placement section on which the flat thread is fixed forms a woven fabric with the warp threads and the weft threads, and thus, the flat thread can be hidden by the woven fabric. As a result, it has become possible to provide a woven fabric and a method for manufacturing the woven fabric for which neither the appearance nor the function provided by the flat thread of the woven fabric are impaired.

Other objects, configurations, and effects of the present invention will become apparent from the following description of embodiments of the present invention.

BRIEF DESCRIPTION OF THE DRAWINGS

FIG. 1 is a perspective view of a woven fabric by a method of the present invention.

FIG. 2 is a photograph of the woven fabric shown in FIG. 1.

FIGS. 7A and 7B show operation of the reed, in which FIG. 7A shows a state where a weft thread is sent, and FIG. 7B shows a state where the weft thread is pressed with the reed.

FIGS. 9A through 9C show cross-sectional views of the woven fabric shown in FIG. 8, in which FIG. 9A is a cross-sectional view in P1, FIG. 9B is a cross-sectional view in P2, and FIG. 9C is a cross-sectional view in P3.

FIGS. 13A through 13C show cross-sectional views of the woven fabric shown in FIG. 12, in which FIG. 13A is a cross-sectional view in P4, FIG. 13B is a cross-sectional view in P5, and FIG. 13C is a cross-sectional view in P6.

FIGS. 17A and 17B show cross-sectional views of the woven fabric shown in FIG. 16, in which FIG. 17A is a cross-sectional view in P7, and FIG. 17B is a cross-sectional view in P8.

FIGS. 19A and 19B show cross-sectional views of the woven fabric shown in FIG. 18, in which FIG. 19A is a cross-sectional view in P9, and FIG. 19B is a cross-sectional view in P10.

FIGS. 21A and 21B show cross-sectional views of the woven fabric shown in FIG. 20, in which FIG. 21A is a cross-sectional view in P11, and FIG. 21B is a cross-sectional view in P12.

FIGS. 25A and 25B show cross-sectional views of the woven fabric shown in FIG. 24, in which FIG. 25A is a cross-sectional view in P13, and FIG. 25B is a cross-sectional view in P14.

FIGS. 29A and 29B show cross-sectional views of the woven fabric shown in FIG. 28, in which FIG. 29A is a cross-sectional view in P15, and FIG. 29B is a cross-sectional view in P16.

FIGS. 37A through 37F show modifications of the functional thread, in which FIG. 37A shows a tube, FIG. 37B shows a spiral tube, FIGS. 37C to 37E respectively show cases where three, six, and seven tubes are bundled to form one functional thread, and FIG. 37F shows a case where an optical fiber, electrodes, and a tube are bundled to form one functional thread.

FIG. 39B shows a state where the module is rounded.

FIGS. 40A and 40B show perspective views of an example of the artificial muscle shown in FIGS. 39A and 39B, in which FIG. 40A shows a state where the muscle module is extended, and FIG. 40B shows a state where the module is contracted.

DESCRIPTION OF EMBODIMENTS

Figure 3:
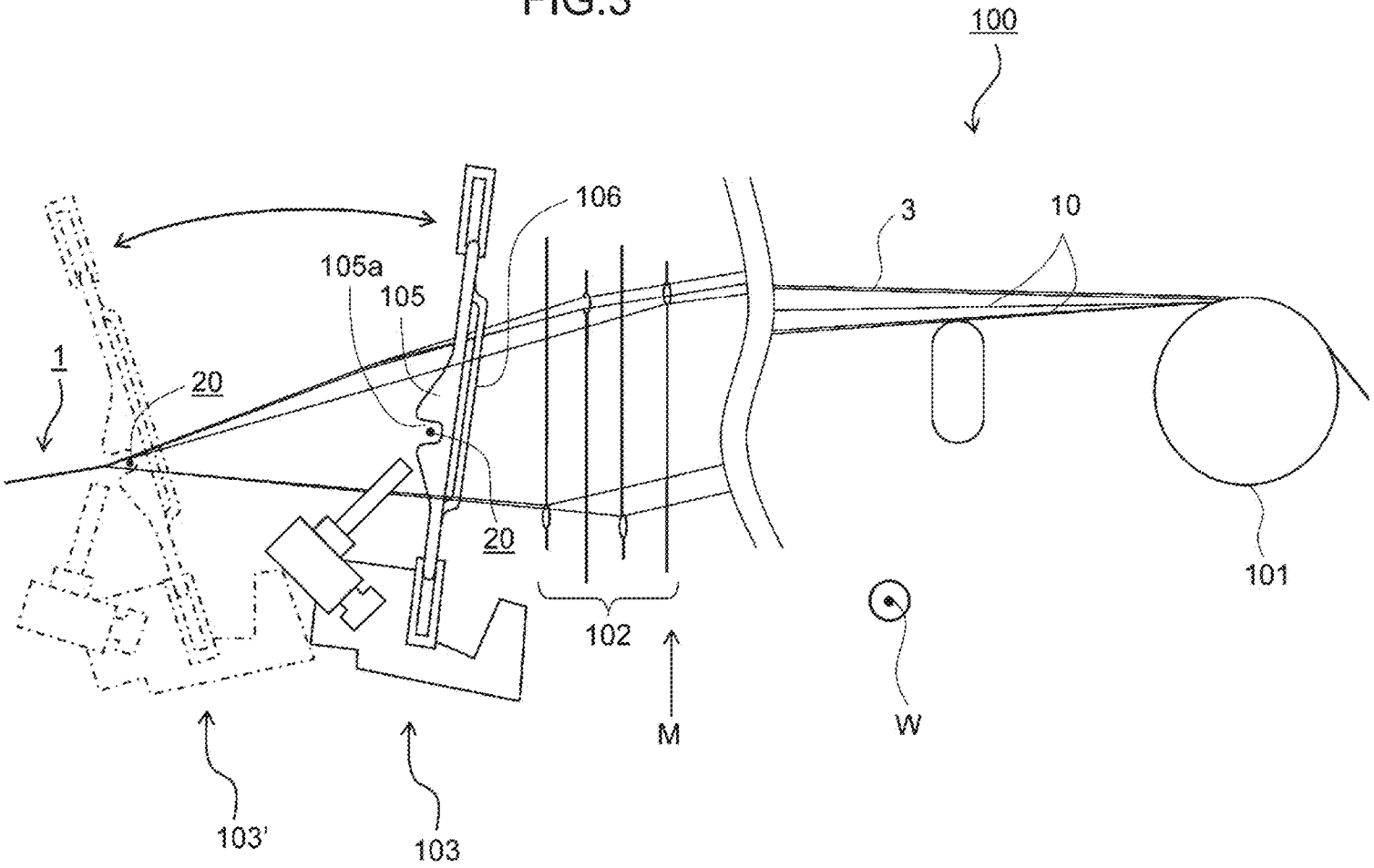
FIG. 3 is a loom according to the present invention.

Next, with reference to attached drawings as appropriate, the present invention will be described further in detail. As shown in FIGS. 1 and 2, a woven fabric 1 according to the present invention is formed by arranging in a weft direction W a plurality of flat threads 3 to be held on a woven fabric fiber part 2, each flat thread 3 being oriented along a warp direction L of the woven fabric fiber part 2. The woven fabric fiber part 2 is formed by weaving fiber warp threads 10 and fiber weft threads 20 on a loom.

Each flat thread 3 has a synthetic resin body having a rectangular cross section in the present embodiment, but may be formed by a flat cable or the like. As the material for the flat thread 3, polyolefin, polycarbonate, polyamide, polyphenylene sulfide, polyetherimide, polyether ketone, polyamide-imide, polypropylene, ABS, or the like can be used for example. In the present embodiment, the flat thread 3 is formed so as to be able to plastically deform. The shape of the entirety of the woven fabric 1 can be held as desired by bending of the flat threads 3.

The fiber warp threads 10 and the fiber weft threads 20 forming the woven fabric fiber part 2 are each a natural fiber or a fiber made of synthetic resin. In the woven fabric fiber part 2, a plurality of woven fabric base section, which is a basic unit indicated by reference character R1, are arranged in the weft direction W. Each woven fabric base section R1 is composed of a woven fabric placement section R3 on which the flat thread 3 is placed, and a woven fabric connection section R2 which connects a plurality of woven fabric placement sections R3.

Desirably, the fiber warp threads and the fiber weft threads are each not less than 10 denier and not greater than 4000 denier. In addition, the weft density (including threads on the flat thread) of the woven fabric placement section R3 is desirably not less than 8 threads/inch and not greater than 500 threads/inch.

FIGS. 3 to 7 show the structure of a loom 100. In the loom 100, a large number of warp threads 10 reeled out along the weft direction W via a roller 101 are caused to pass through holes of a plurality of healds 102. Air jet causes the fiber weft thread 20 to pass along grooves 105*a* of a reed 103 in the direction from an arrow W1 toward and arrow W2 shown in FIG. 7(*a*). Then, as indicated by reference character 103' in FIG. 3 and in FIG. 7(*b*), the reed 103 is moved toward the formation side of the woven fabric 1, to bring the fiber warp threads and the fiber weft thread into close contact with each other, thereby to produce the woven fabric 1.

Figure 4:
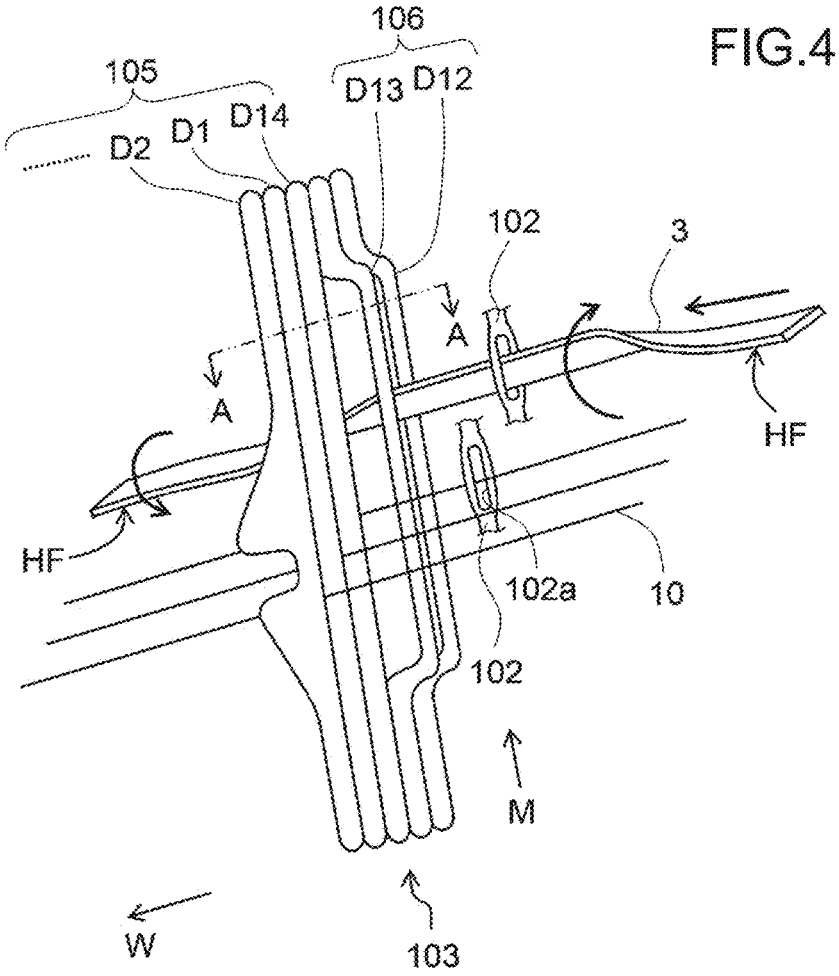
FIG. 4 is a perspective view of a reed.
Figure 5:
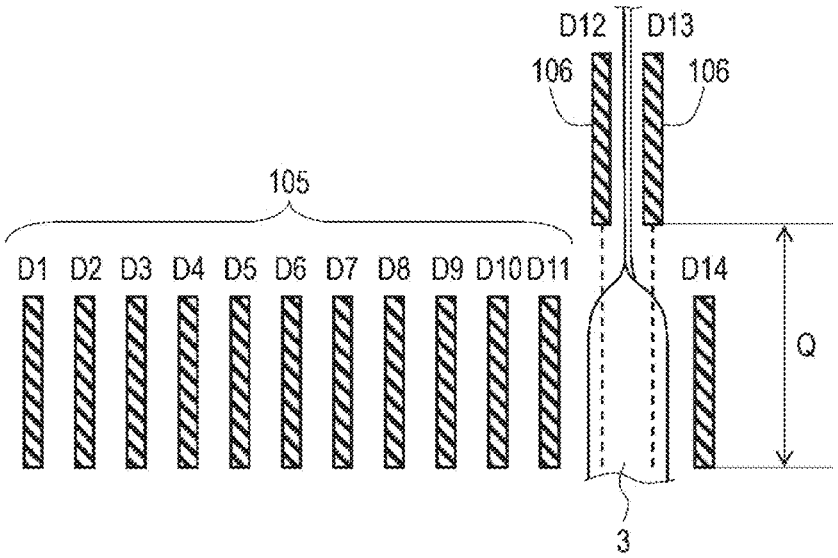
FIG. 5 is an A-A cross-sectional view of the reed shown in FIG. 4.

As shown in FIGS. 3 to 5, the reed 103 is formed by arranging a plurality of dents 105 and a plurality of back dents 106. The dents 105 are repeated in units of 12 dents as indicated by reference characters D1 to D11 and D14, and the back dents 106 are repeated in units of 2 back dents as indicated by reference characters D12 and D13. The repeated unit of twelve dents 105 and two back dents 106 corresponds to the woven fabric base section R1 mentioned above.

Figure 6A:
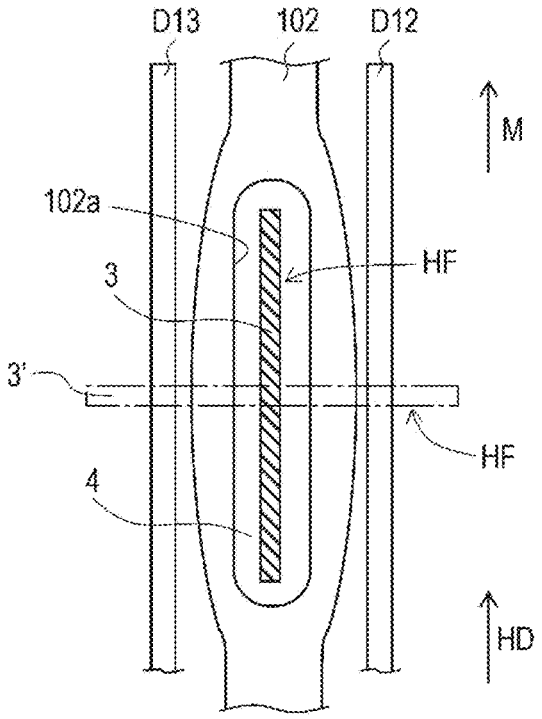
FIG. 6A is an enlarged rear view of a heald.
Figure 6B:
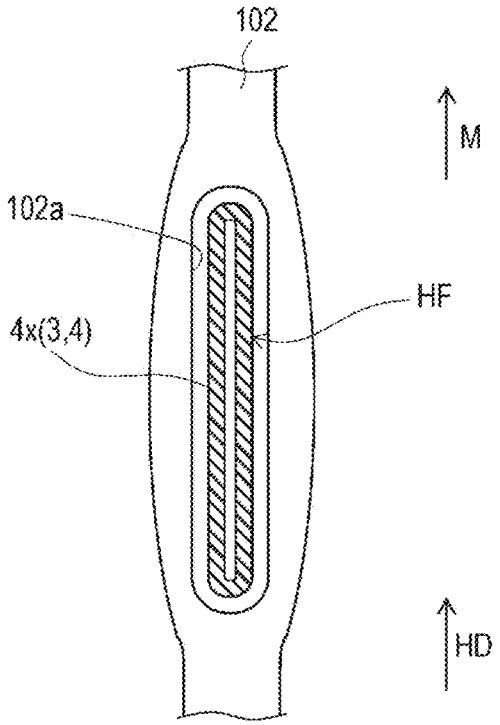
FIG. 6B is an enlarged rear view of a heald of an example in which a hollow functional thread 4*x* (4) is used as a flat thread.
Figure 7A:
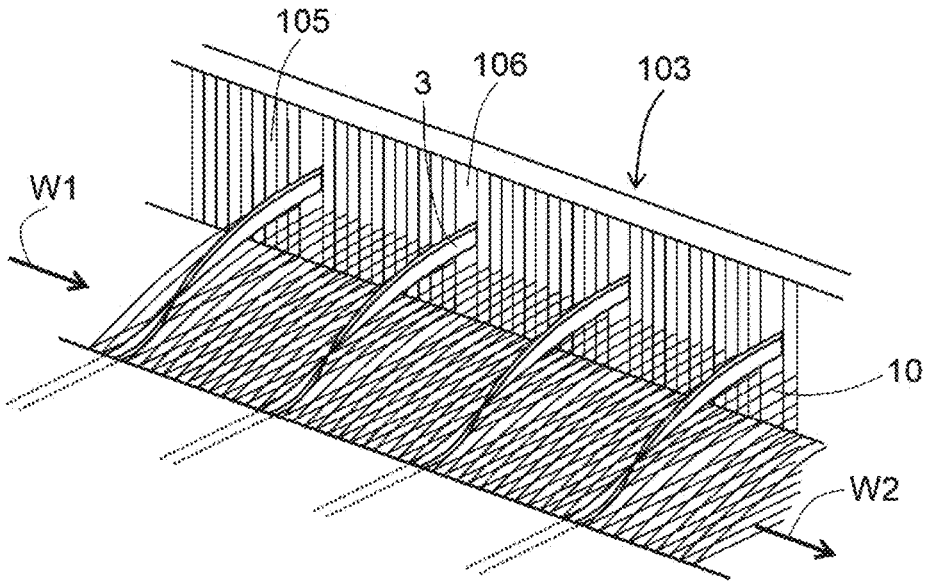
Figure 7B:
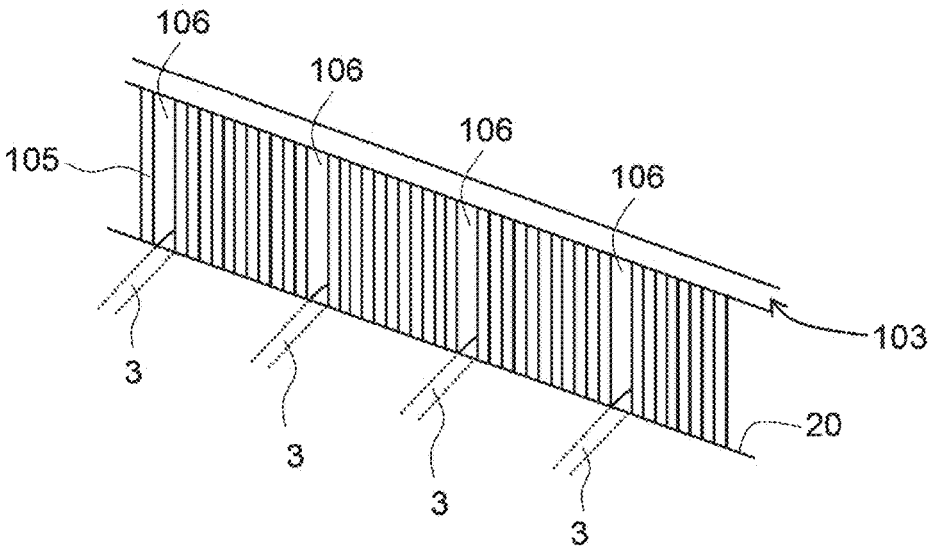

Each dent 105 has the groove 105*a* mentioned above, and is used in sending out and interweaving the fiber weft thread 20. In contrast, each back dent 106 does not have the groove 105*a* mentioned above, and is offset to the roller 101 side relative to the dent 105, as shown in FIGS. 5 and 6.

As shown in FIGS. 3 and 4, each fiber warp thread 10 and each flat thread 3 pass through their corresponding holes of the healds 102. Each heald 102 is configured to independently move in the up-down direction. As shown in FIG. 6, the longitudinal direction of a heald hole 102*a* is oriented along the heald moving direction M. The fiber warp threads 10 having passed through the holes of the healds 102 pass between the dents D1 to D14, to be interwoven with the fiber weft thread 20 in the vicinity of the woven fabric 1.

The flat thread 3 is wound to be reeled out such that its flat face HF faces the surface of the roller 101 on the roller 101 side. In addition, also on the woven fabric 1, the flat face HF faces the plane of the woven fabric fiber part 2. However, in the vicinity of the healds 102 and the back dents 106, the flat thread 3 is caused to vertically pass through the heald hole 102*a*, with a longitudinal direction in transverse plane HD of the flat thread 3 also oriented along the heald moving direction M, and thus, the flat thread 3 passes vertically also between a pair of back dents 106.

Since the longitudinal direction in transverse plane HD of the flat thread 3 is also oriented along the heald moving direction M, the distance between back dents 106 and 106 is small. Moreover, fiber warp threads are supplied also from between a dent 105 and a back dent 106. Thus, also under the flat thread that has been placed horizontally as indicated with reference character 3', the fiber warp threads can be sufficiently accommodated. In addition, since the distance between back dents is small, the fiber warp threads need not be forcefully pushed in a narrow space, and thus, the fiber warp threads do not rub each other.

With reference to FIG. 44, the relationship between the flat thread 3 and the fiber warp thread 10 described above will be described further in detail. FIG. 44(*a*) shows a state where the flat face HF of the flat thread 3 is oriented horizontally and the longitudinal direction in transverse plane HD thereof is set to be orthogonal to the heald moving direction M. In this case, since the healds can be arranged only sideways, the fiber warp threads 10 are also arranged sideways of the flat thread 3. As a result, the interval between a pair of back dents D12' and D13' (106) is increased, and in addition, it cannot be helped that the fiber warp threads 10 are disposed in an excessively dense state.

If weaving is performed in this state, an arrangement as shown in FIG. 44(*b*) is obtained. The fiber warp threads 10 are woven with the fiber weft threads 20, with a large proportion of the place taken by the flat thread 3. Therefore, for example, even if the fiber warp threads indicated by reference character 10*x* are to go under the flat thread 3, the fiber warp threads cannot move to the center portion of the flat thread 3 due to the friction with the fiber weft threads 20. This makes it difficult to form the woven fabric placement section R3 described above.

In contrast, as shown in FIG. 44(*c*), when the longitudinal direction in transverse plane HD of the flat thread 3 is oriented along the heald moving direction M with the flat face HF thereof set vertically, the distance between the back dents D12 and D13 is decreased. In addition, the fiber warp threads 10 can be disposed with enough room between the back dents D12 and D13, as well as between a back dent and a dent, i.e., between D11 and D12, and between D13 and D14. As a result, as shown in FIG. 44(*d*), the fiber warp threads 10 are woven with the fiber weft threads 20, with hardly any movement in the horizontal direction. Then, the flat thread changes its posture from the position indicated by reference character 3' to the position indicated by reference character 3, to be placed on the woven fabric placement section R3.

Here, as shown in FIGS. 4 and 5, the backs dent 106 are offset to the roller 101 side by a distance Q relative to the dents 105. Therefore, when the flat thread 3 having been vertically set between the back dents 106 is to be pressed with the fiber weft thread 20, the posture of the flat thread 3 can be easily changed from the vertical posture to a horizontal posture, because of the offset distance. Therefore, also on the woven fabric 1, the flat face HF can be caused to face the plane of the woven fabric fiber part 2, to be brought into close contact with the plane of the woven fabric fiber part 2.

Figure 8:
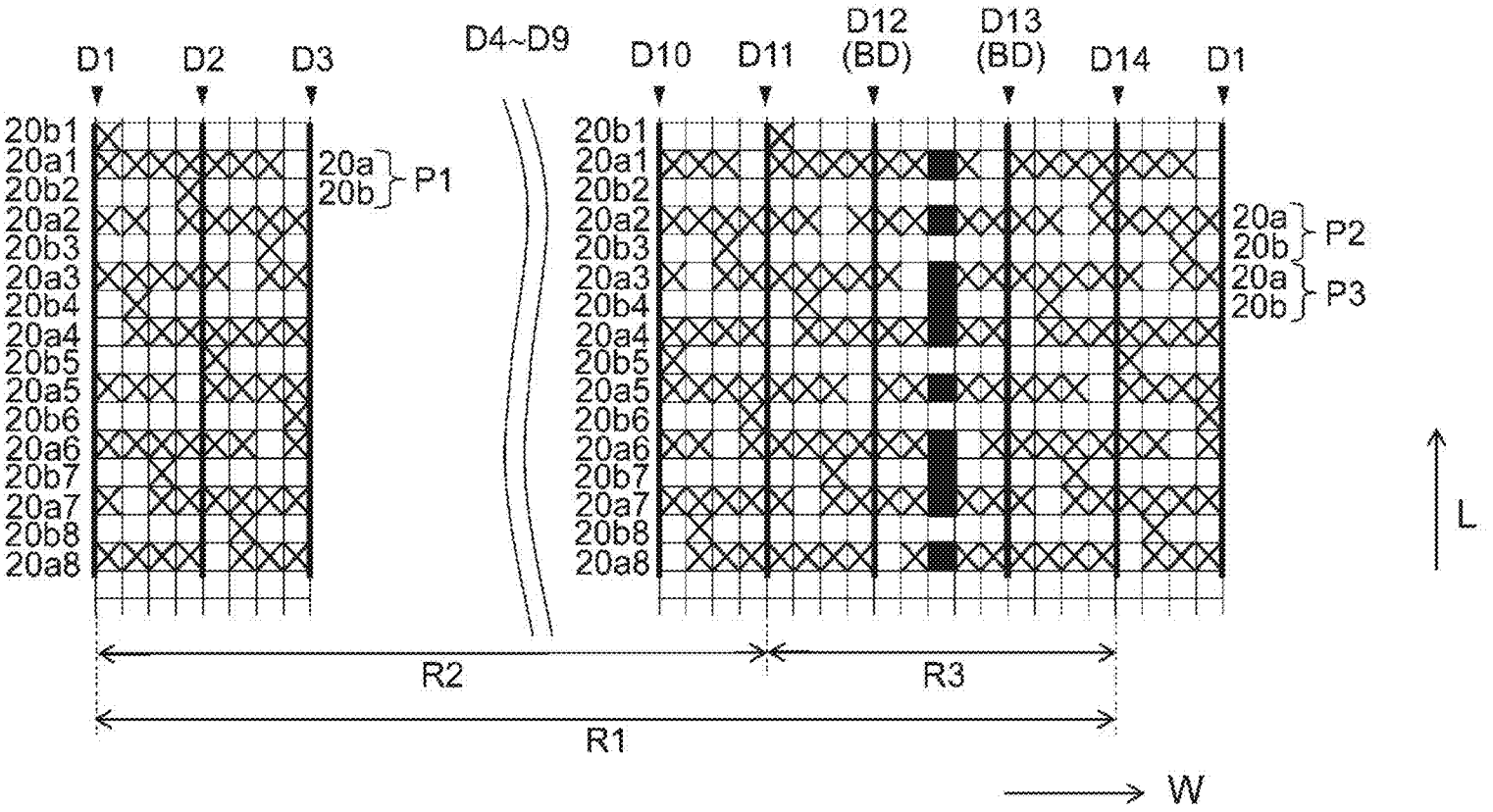
FIG. 8 is a structure diagram showing the positional relationship between the woven fabric and dents.
Figure 9A:
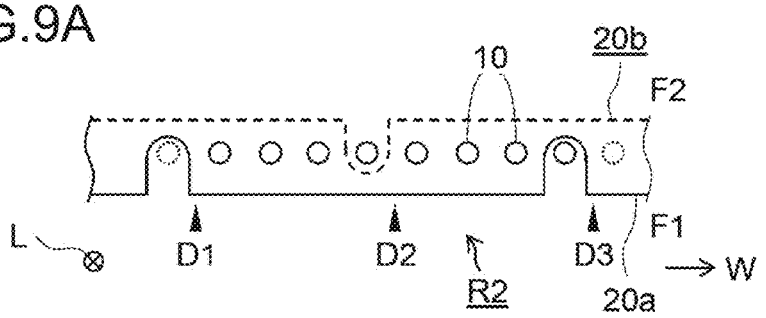
Figure 9B:
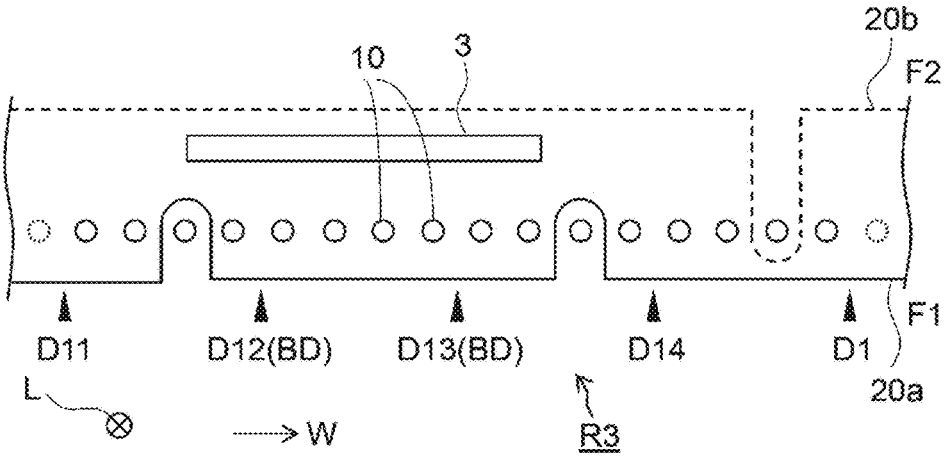
Figure 9C:
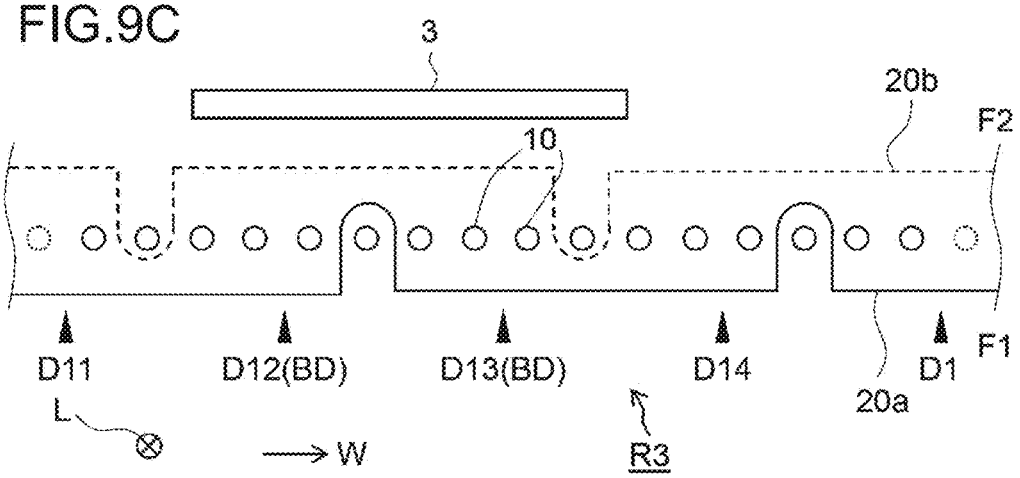
Figure 10:
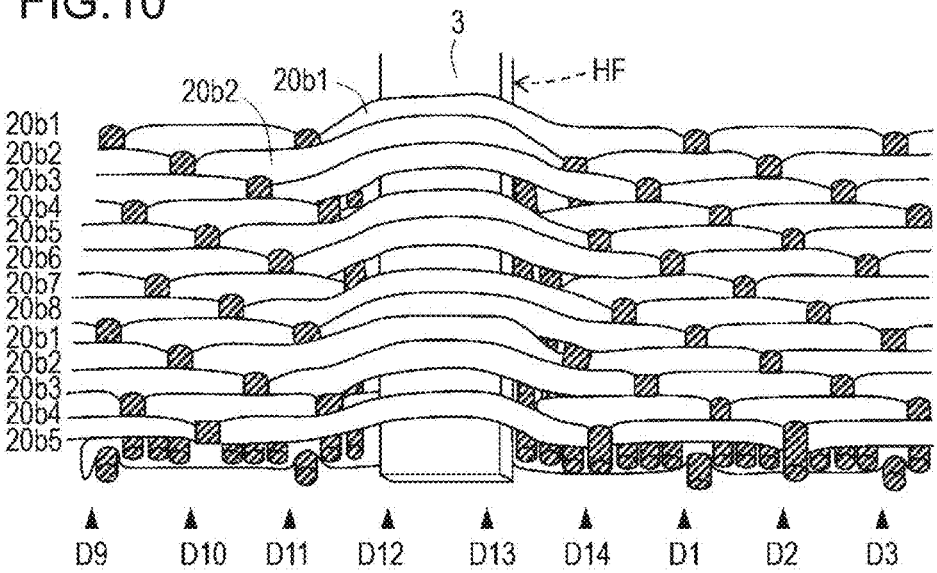
FIG. 10 is a perspective view from the rear face (F2) side of the woven fabric shown in FIG. 8.
Figure 11:
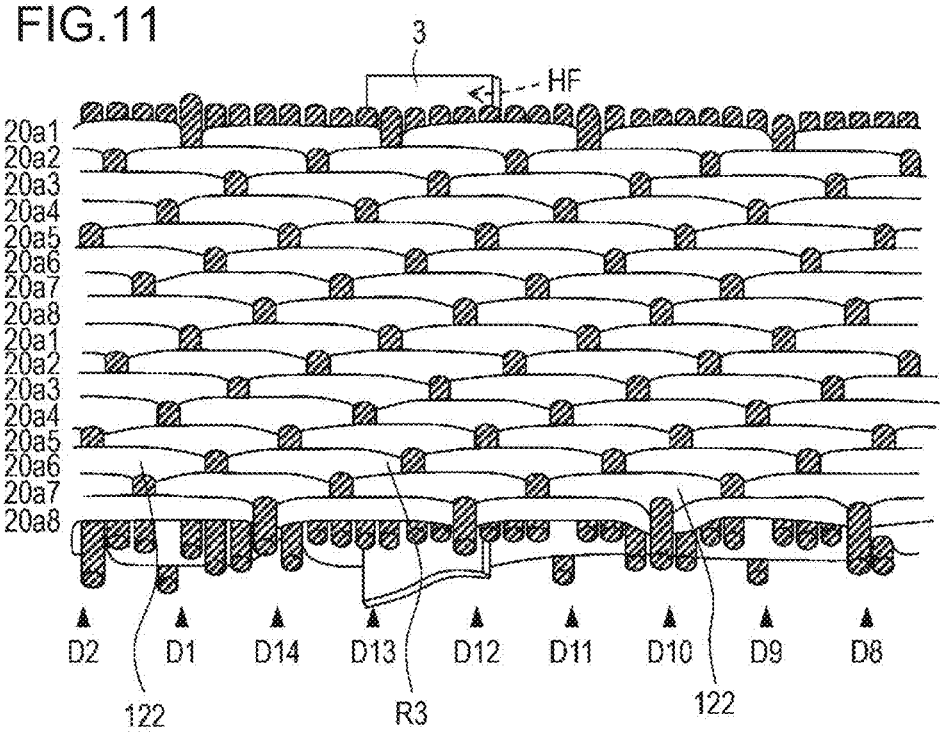
FIG. 11 is a perspective view from the front face (F1) side of the woven fabric shown in FIG. 8.

Next, one example of a woven fabric according to the present invention will be shown with reference to FIGS. 8 to 11. This woven fabric has a double weft structure in which: the flat thread 3 is pressed and fixed by fiber weft threads 20*b* on a second face F2 side as shown in FIG. 10; and the flat thread 3 is hidden by the woven fabric placement section R3 and does not appear on a first face F1 side, in a state where the woven fabric placement section R3 is continued with the woven fabric connection section R2.

The fiber weft thread 20 includes a first weft thread 20*a* and a second weft thread 20*b*, thereby forming the double weft structure. It should be noted that in order to facilitate mutual reference of weft threads in the drawings, the first weft thread 20*a* is indicated as first weft threads 20*a*1, 20*a*2, 20*a*3 . . . , and the second weft thread 20*b* is indicated as second weft threads 20b1, 20b2, 20b3 . . . , and the like. This indication also applies to other embodiments below.

FIG. 8 is a structure diagram of a woven fabric, in which the up-down direction is the warp direction L and the left-right direction is the weft direction W. D1 to D14 indicate the positions of dents, respectively, and for example, four warp threads pass between the dents D1 and D2. Moreover, the fiber weft threads are to be disposed side by side along the warp direction L which is the up-down direction, and the cross sections of a first portion P1 to a third portion P3 are shown in FIGS. 9(*a*) to 9(*c*), respectively.

In the view from the second face F2, the part where the fiber weft thread 20 is hidden is marked with x, and the part where the fiber weft thread 20 is seen is left blank. The black vertical line between the back dents D12 and D13 corresponds to the flat thread 3, and each white part in this black vertical line is the part where the fiber weft thread crosses over the flat thread 3. Although four fiber warp threads 10 are present also between D12 and D13, the distance between the back dents D12 and D13 is the same as the distance between other dents.

The portion from the dent D1 to the dent D11 corresponds to the woven fabric connection section R2, and the portion from the dent D11 to the dent D14 corresponds to the woven fabric placement section R3. The first portion P1 is representative in the portion from the dent D1 to the dent D11. As shown in FIG. 9(*a*), the first fiber weft thread 20a is predominant on the first face F1 side, and this portion is formed as a 7/1 structure. In contrast, the second fiber weft thread 20b is predominant on the second face F2 side, and this portion is formed as a 7/1 structure.

With respect to the second portion P2 shown in FIG. 9(*b*), the basic part of the woven fabric placement section R3 is formed as a 7/1 structure, with the first fiber weft thread 20a being predominant on the first face F1 side. In contrast, the second fiber weft thread 20b is predominant on the second face F2 and presses the flat thread 3 to fix, thus consequently forming a combination weave. The third portion P3 shown in FIG. 9(*c*) has the same structure as shown in FIG. 9(*a*) with the flat thread 3 placed thereon.

According to this embodiment, the part, of the woven fabric placement section R3, that is in the vicinity of the fiber weft thread passing over the flat thread 3 is in a double weft structure (double horizontal structure) including the fiber weft thread 20 passing over the flat thread 3. In addition, the fiber warp threads 10 are tightly close to each other for the reason described above. Thus, by interweaving the fiber weft thread 20 (20a) with the fiber warp threads 10, it is possible to form the woven fabric placement section R3 as a woven fabric structure.

Here, other embodiments of the present invention will be shown below, and like members are denoted by like reference characters.

Figure 12:
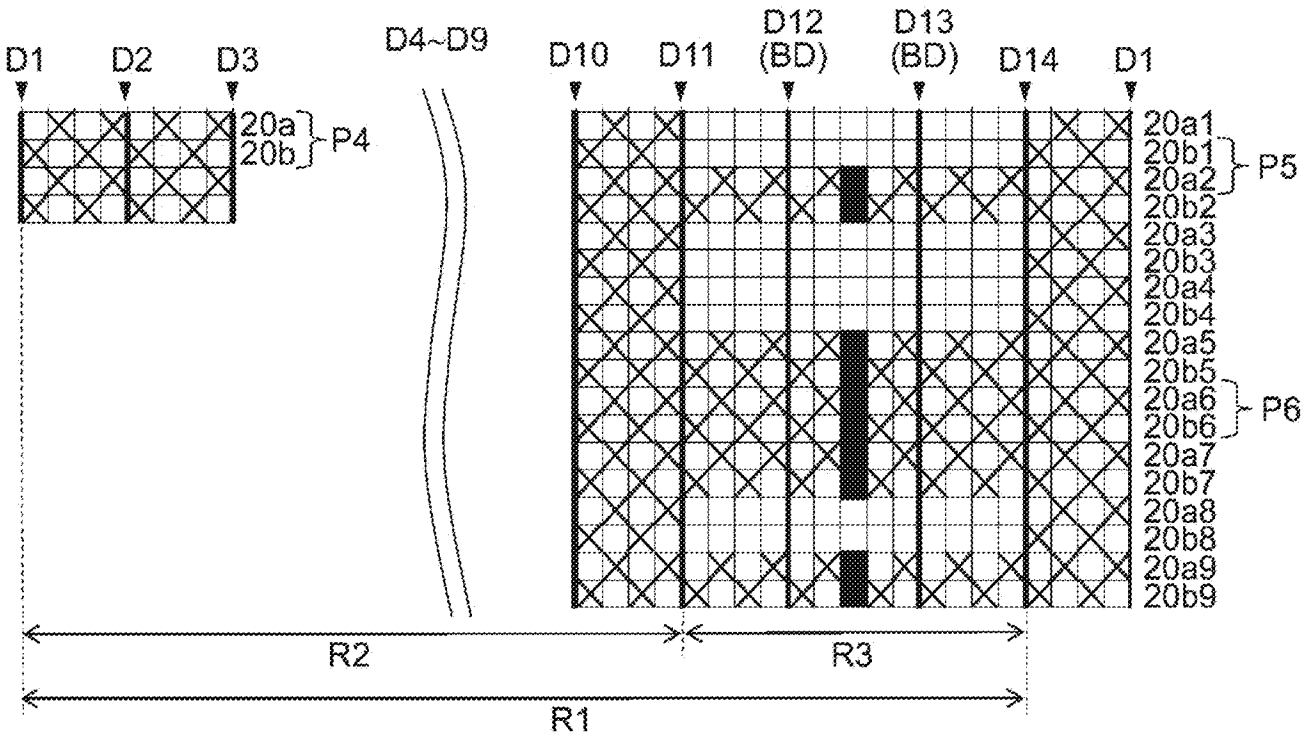
FIG. 12 is a structure diagram showing the positional relationship between a woven fabric and dents according to a second embodiment.
Figure 13A:
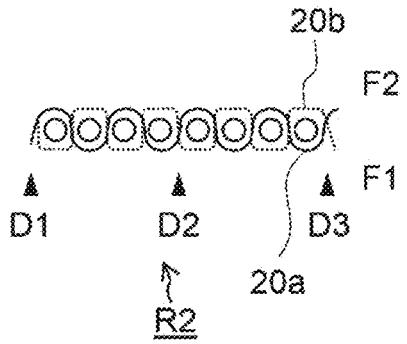
Figure 13B:
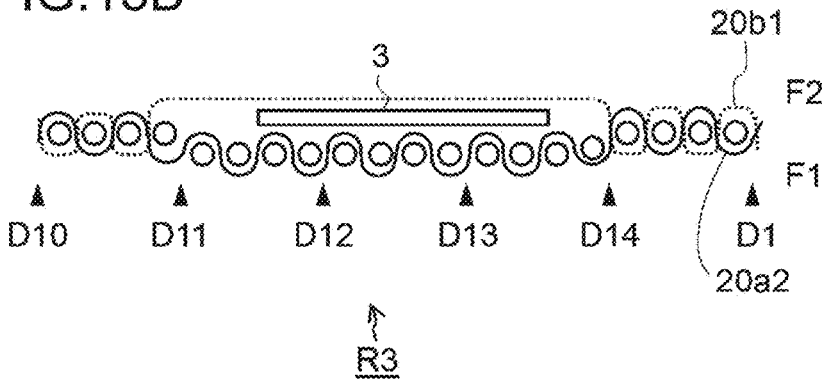
Figure 13C:
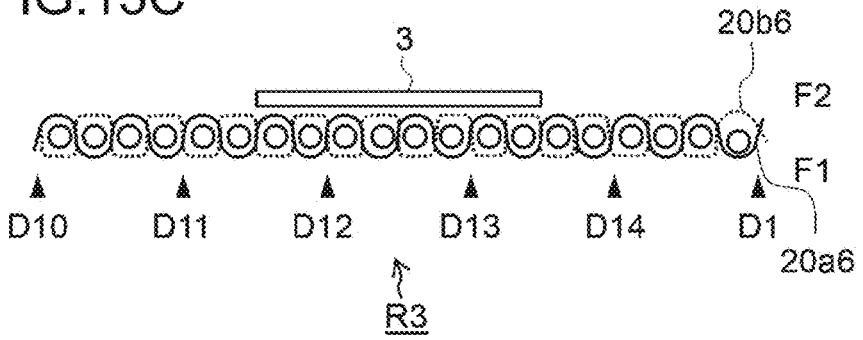

In a second embodiment shown in FIGS. 12 to 15, similarly to the above, the portion from the dent D1 to the dent D11 corresponds to the woven fabric connection section R2, and the portion from the dent D11 to the dent D14 corresponds to the woven fabric placement section R3. As shown in FIG. 13(*a*), a fourth portion P4 forming the woven fabric connection section R2 is formed as a plain weave. A sixth portion P6 also has the same structure as that of the fourth portion P4, but on the upper side, the flat thread 3 is placed on the woven fabric placement section R3. In a fifth portion P5 shown in FIG. 13(*b*), the first woven fabric weft thread 20a2 forms a plain weave, and the second fiber weft thread 20b1 crosses and fixes the flat thread 3, thus consequently forming a combination weave.

Figure 14:
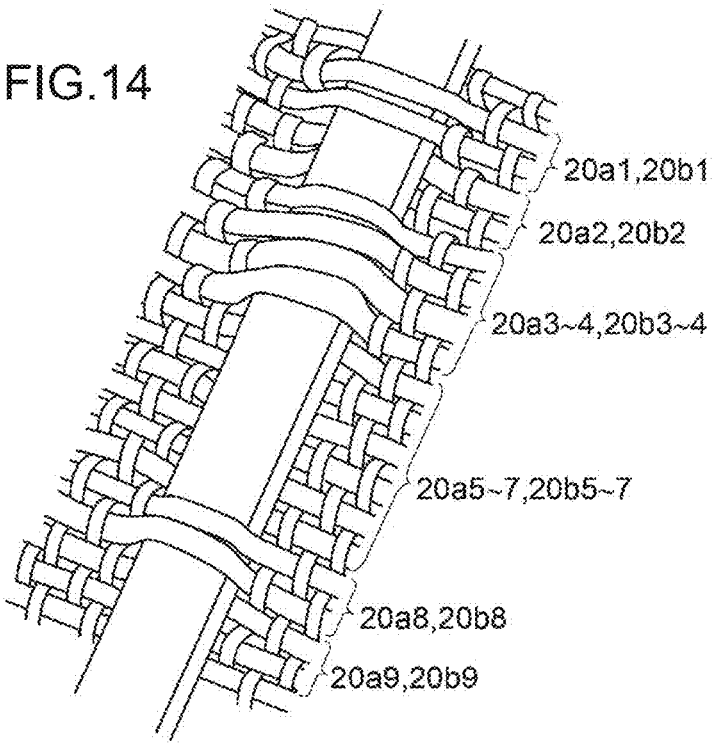
FIG. 14 is a perspective view from the rear face (F2) of the woven fabric shown in FIG. 12.
Figure 15:
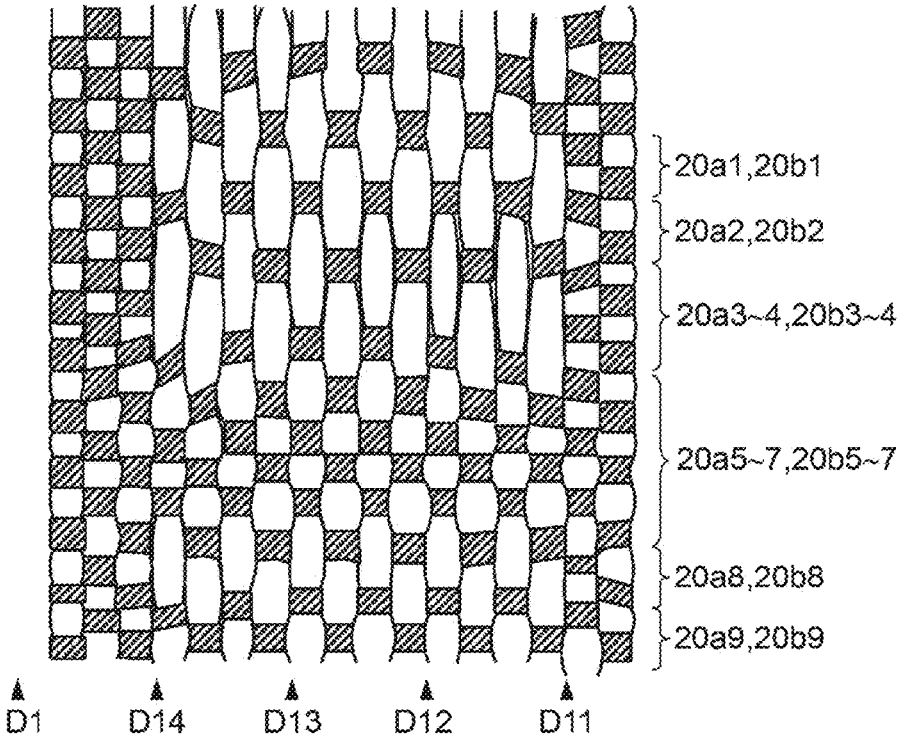
FIG. 15 is a plan view from the front face (F1) side of the woven fabric shown in FIG. 12.

As shown in FIGS. 12 and 14, the fiber weft threads 20 are exposed in bundles on the second face F2 side. However, as shown in FIG. 15, other fiber weft threads move from up and down sides onto the part where the fiber weft threads are exposed on the rear side, to form a woven fabric structure in the woven fabric placement section R3, thereby maintaining the combination weave described above.

Figure 16:
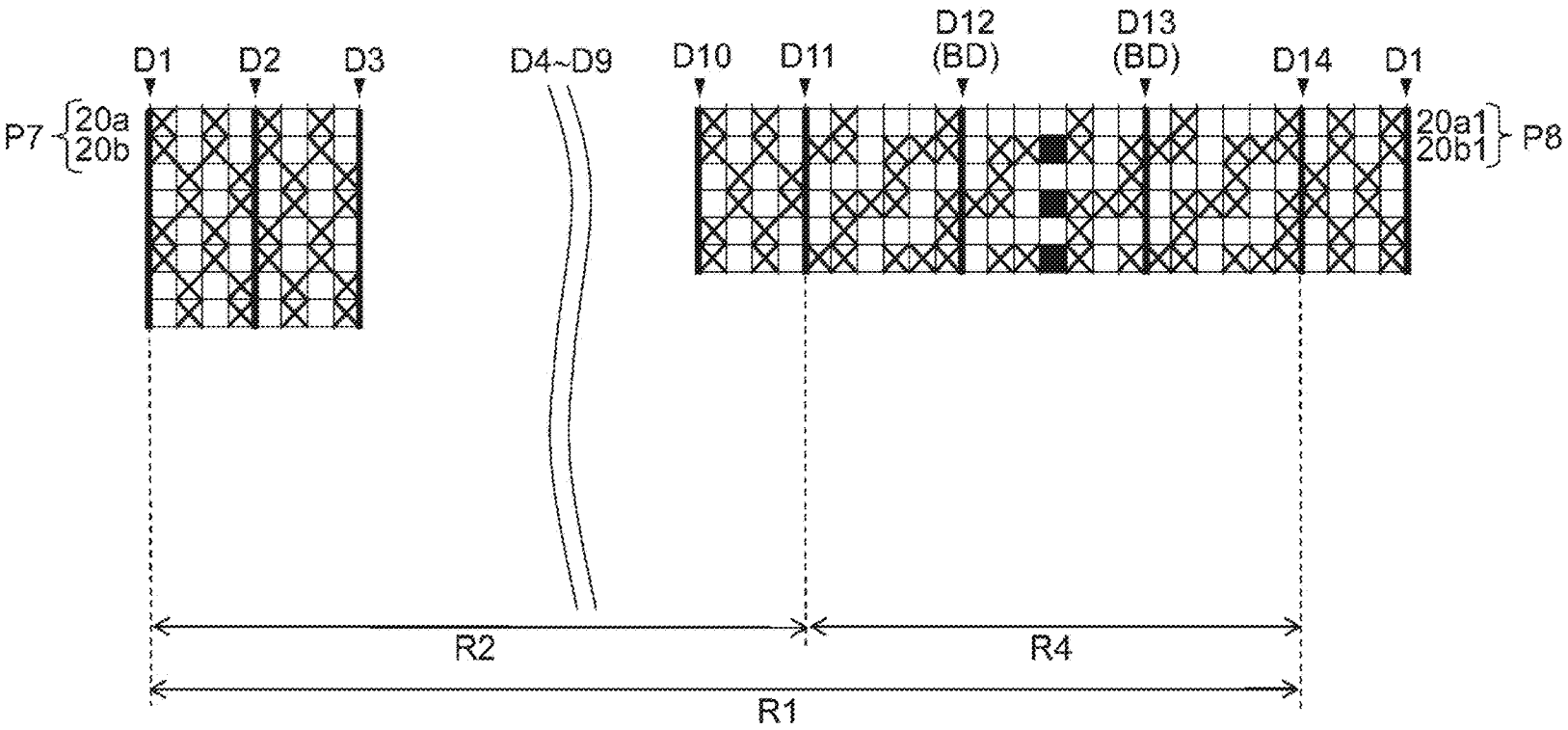
FIG. 16 is a structure diagram showing the positional relationship between a woven fabric and dents according to a third embodiment.
Figure 17A:
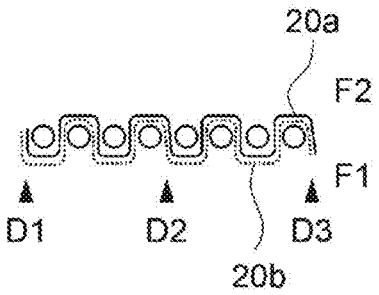
Figure 17B:
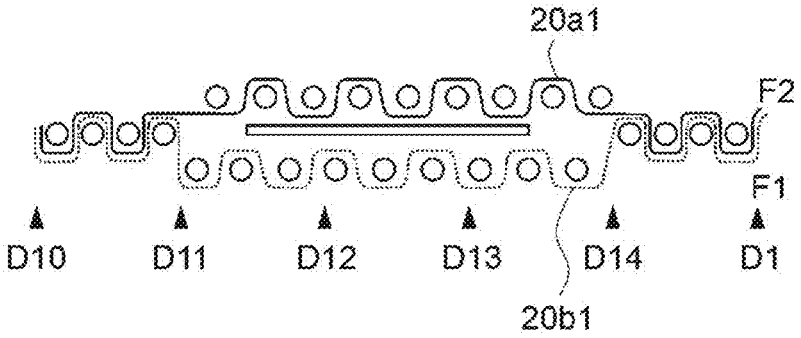

In a third embodiment shown in FIGS. 16 and 17, similarly to the above, the portion from the dent D1 to the dent D11 corresponds to the woven fabric connection section R2, and the portion from the dent D11 to the dent D14 corresponds to the woven fabric placement section R3 and a woven fabric covering section R4. As shown in FIG. 17(*a*), a seventh portion P7 forming the woven fabric connection section R2 is formed as a single structure that is not a plain weave. As shown in FIG. 17(*b*), in an eighth portion P8, the woven fabric placement section R3 and the woven fabric covering section R4 are provided over and under the flat thread 3, and the first fiber weft thread 20a1 and the second fiber weft thread 20b1 form the woven fabric covering section R4 and the woven fabric placement section R3 in a plain weave, on the second face F2 and the first face F1, respectively.

Figure 18:
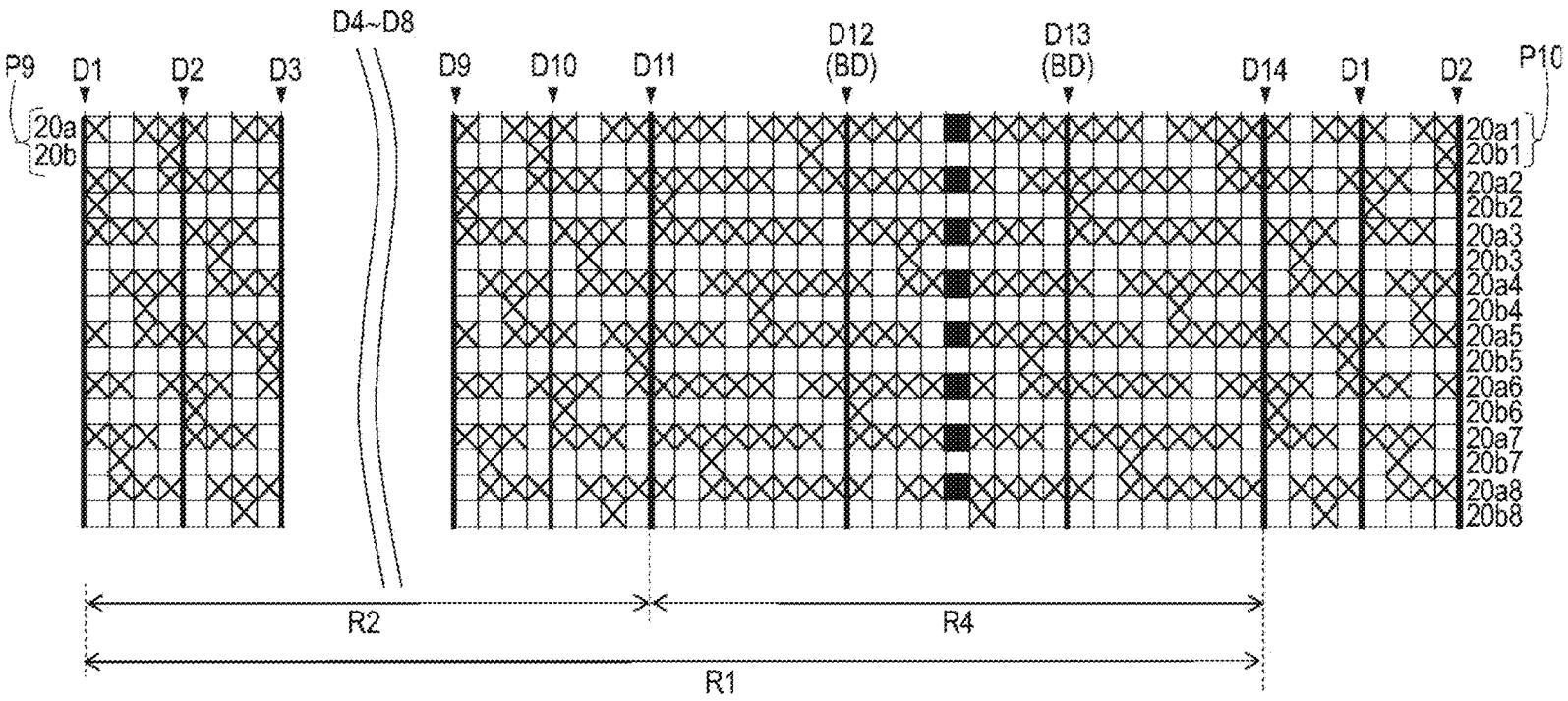
FIG. 18 is a structure diagram showing the positional relationship between a woven fabric and dents according to a fourth embodiment.
Figure 19A:
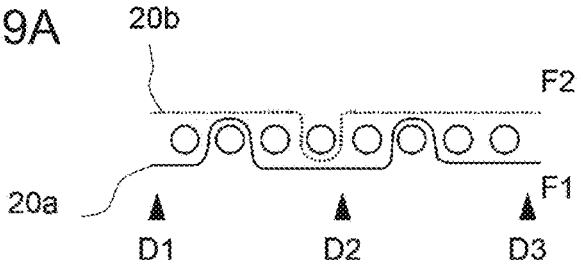
Figure 19B:
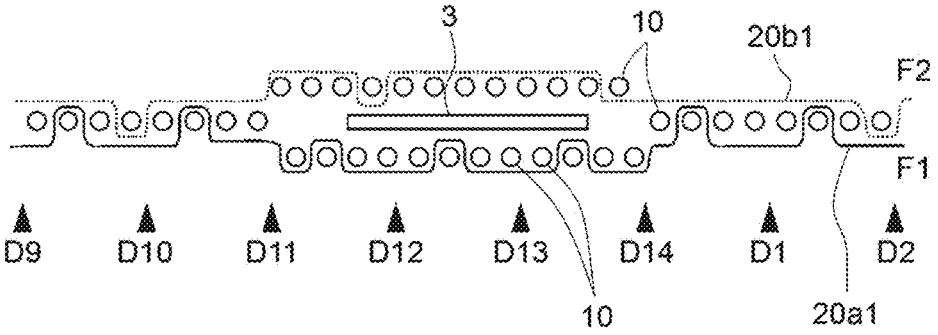
Figure 20:
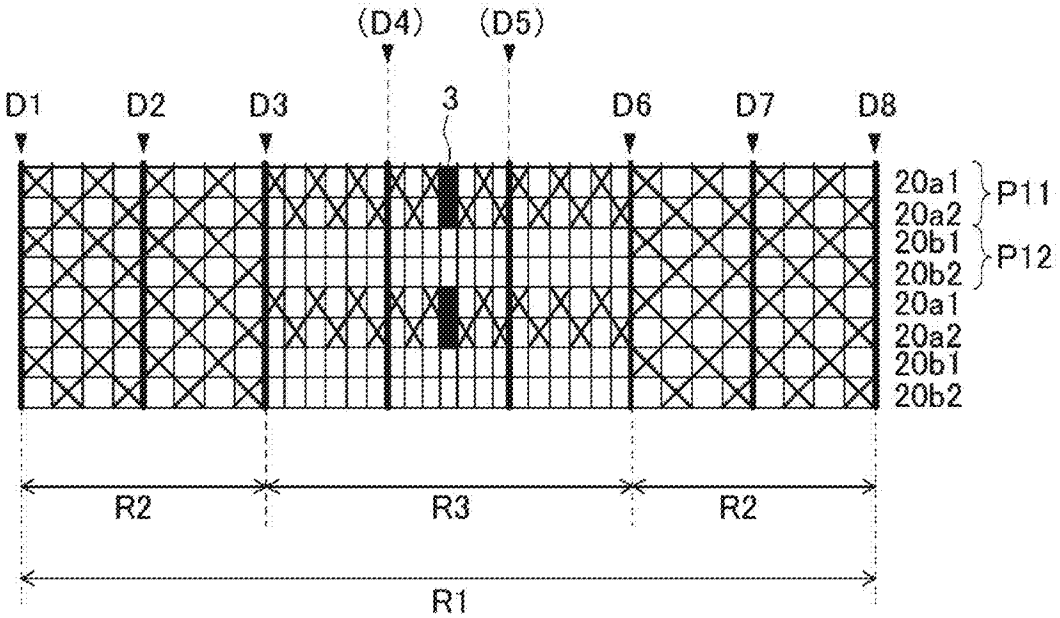
FIG. 20 is a structure diagram showing the positional relationship between a woven fabric and dents according to a fifth embodiment.
Figure 21A:
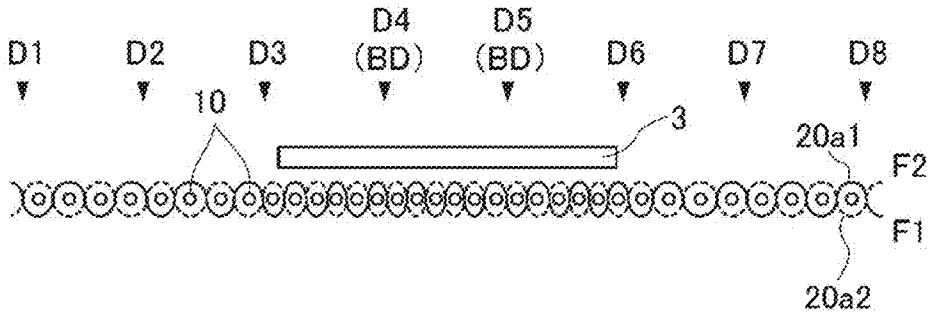
Figure 21B:
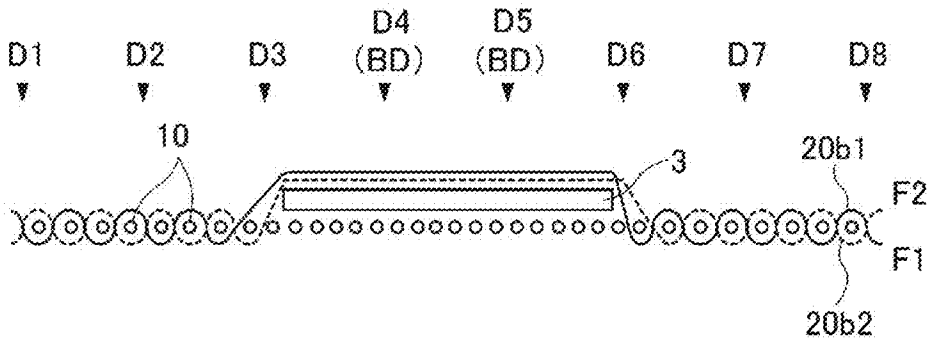
Figure 22:
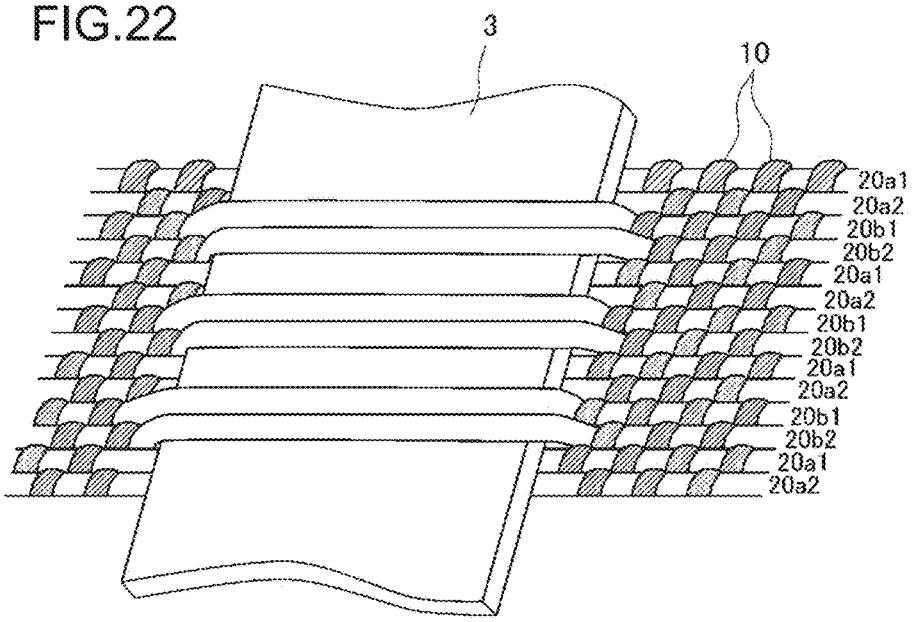
FIG. 22 is a perspective view from the rear face (F2) side of the woven fabric shown in FIG. 20.
Figure 23:
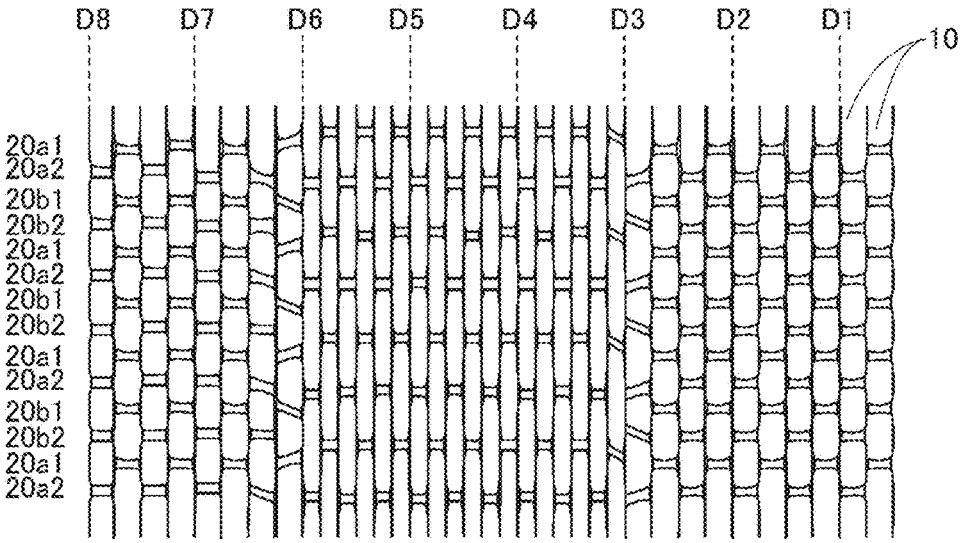
FIG. 23 is a plan view from the front face (F1) side of the woven fabric shown in FIG. 20.

In a fourth embodiment shown in FIGS. 18 and 19, similarly to the above, the portion from the dent D1 to the dent D11 corresponds to the woven fabric connection section R2, and the portion from the dent D11 to the dent D14 corresponds to the woven fabric placement section R3 and the woven fabric covering section R4. As shown in FIG. 19(*a*), a ninth portion P9 forming the woven fabric connection section R2 is formed as a 3/1 and 7/1 double weft structure. As shown in FIG. 19(*b*), in a tenth portion P10, the woven fabric placement section R3 and the woven fabric covering section R4 are provided over and under the flat thread 3, and the first fiber weft thread 20a1 and the second fiber weft thread 20b1 form the woven fabric placement section R3 and the woven fabric covering section R4 on the first face F1 and the second face F2, in the 3/1 structure and the 7/1 structure, respectively. That is, in the present embodiment, the woven fabric placement section R3 and the woven fabric covering section R4 each form a woven fabric structure.

In fifth to seventh embodiments shown in FIGS. 20 to 31, the portion from the dent D1 to the dent D3 and the portion from the dent D6 to the dent D8 correspond to the woven fabric connection section R2, and the portion from the dent D3 to the dent D6 corresponds to the woven fabric placement section R3. The woven fabric placement section R3 is formed as a plain weave, and the flat thread 3 is placed thereon. A flat thread that is five or more times wider than the fiber warp thread is used as the flat thread 3. That is, this case is different from a case where the flat thread 3 that is about two or three times wider than the fiber warp thread is used. Since the flat thread 3 is so wide compared with the fiber warp thread, also when the entirety of the woven fabric is bent, stress is concentrated on this part. Accordingly, the flat thread 3 may be insufficiently hidden on the rear face due to the shift of the fiber warp threads. However, since the woven fabric placement section R3 is a plain weave, the woven fabric placement section R3 is dense although light in weight. Thus, the flat thread can be efficiently hidden, and durability (abrasion resistance) can be enhanced. Further, even when the wide flat thread is laid on the woven fabric placement section R3 to partially cause concentrated stress thereon as described above, since the lengths of floated portions of the threads are small because the woven fabric placement section R3 is a plain weave, the texture is tight and can be made thin. Thus, the problem caused by interweave of the flat thread 3 can be reduced.

Figure 24:
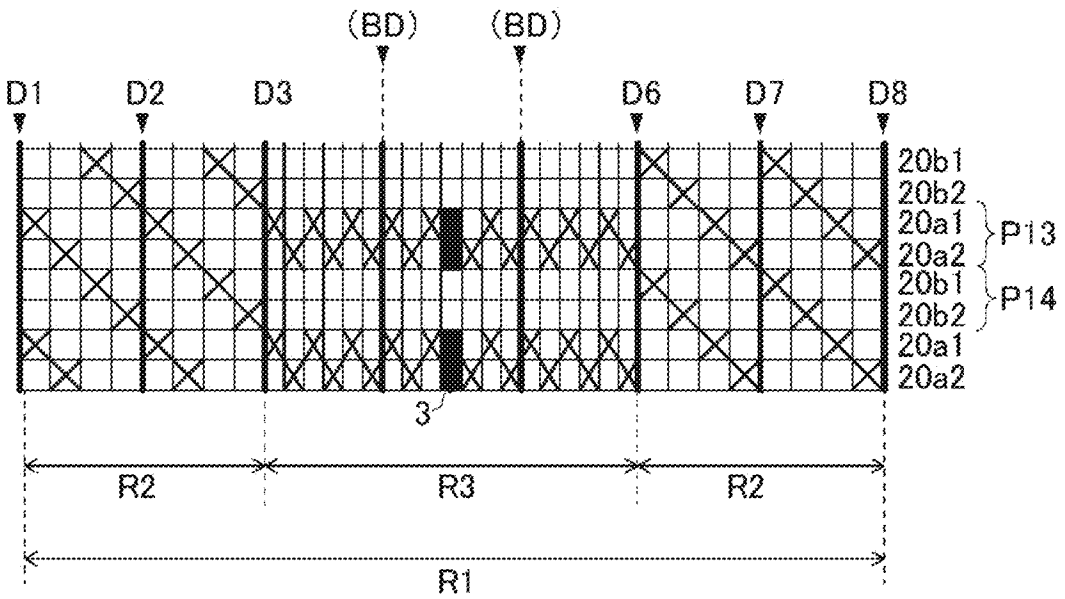
FIG. 24 is a structure diagram showing the positional relationship between a woven fabric and dents according to a sixth embodiment.
Figure 25A:
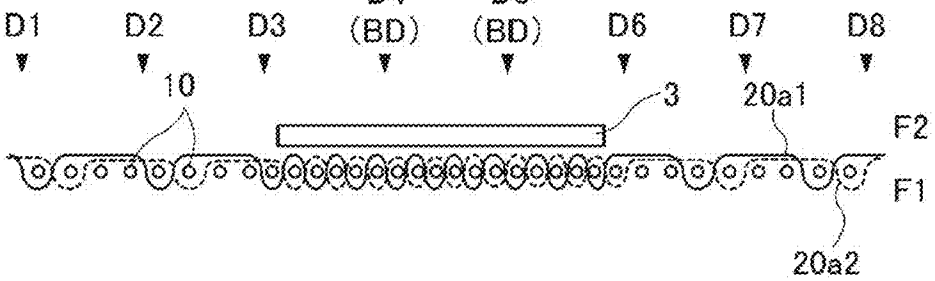
Figure 25B:
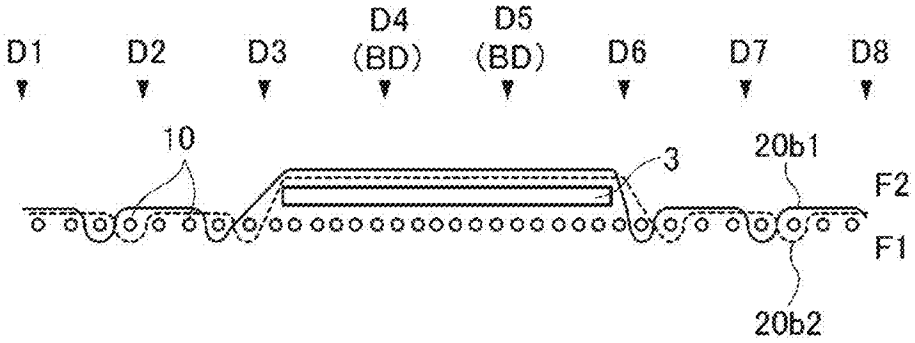
Figure 26:
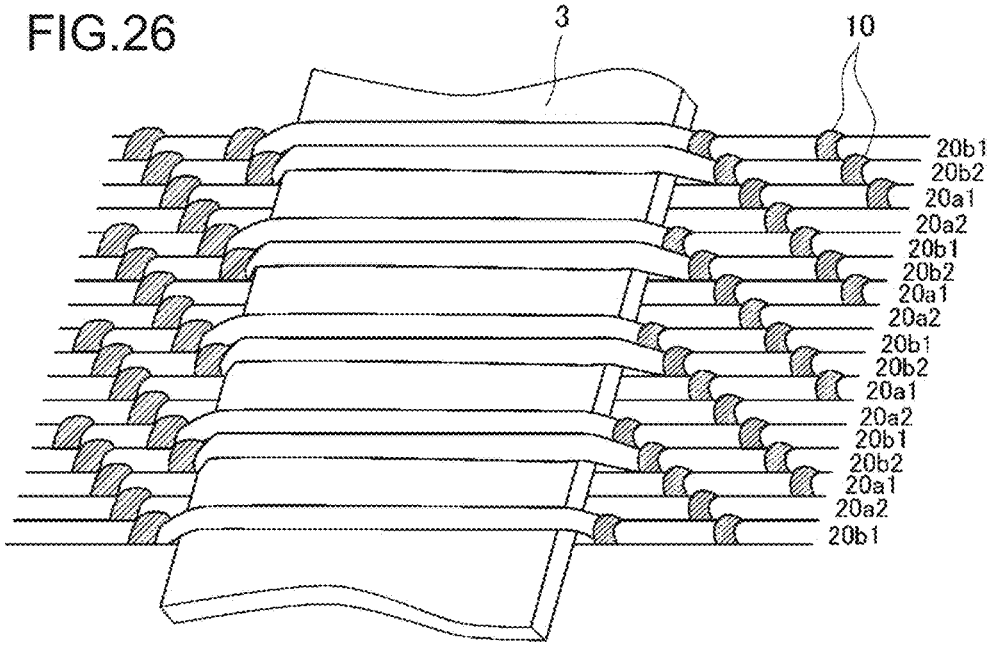
FIG. 26 is a perspective view from the rear face (F2) side of the woven fabric shown in FIG. 24.
Figure 27:
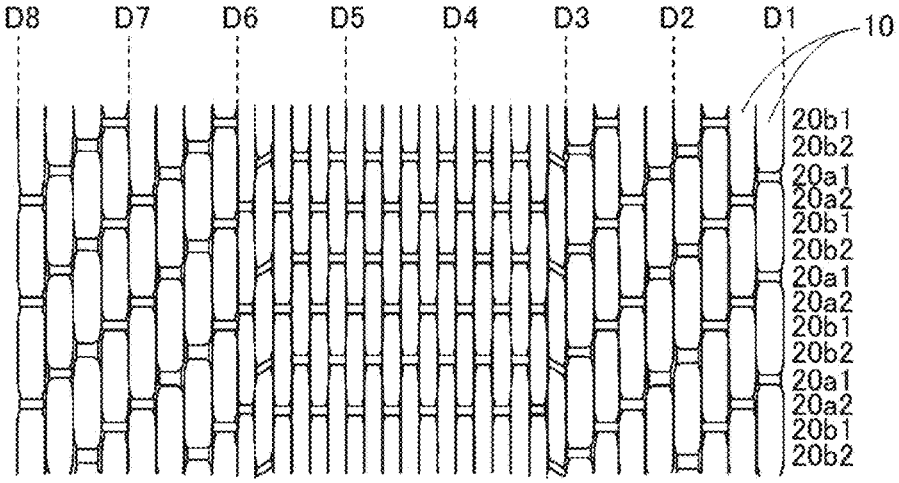
FIG. 27 is a plan view from the front face (F1) side of the woven fabric shown in FIG. 24.
Figure 28:
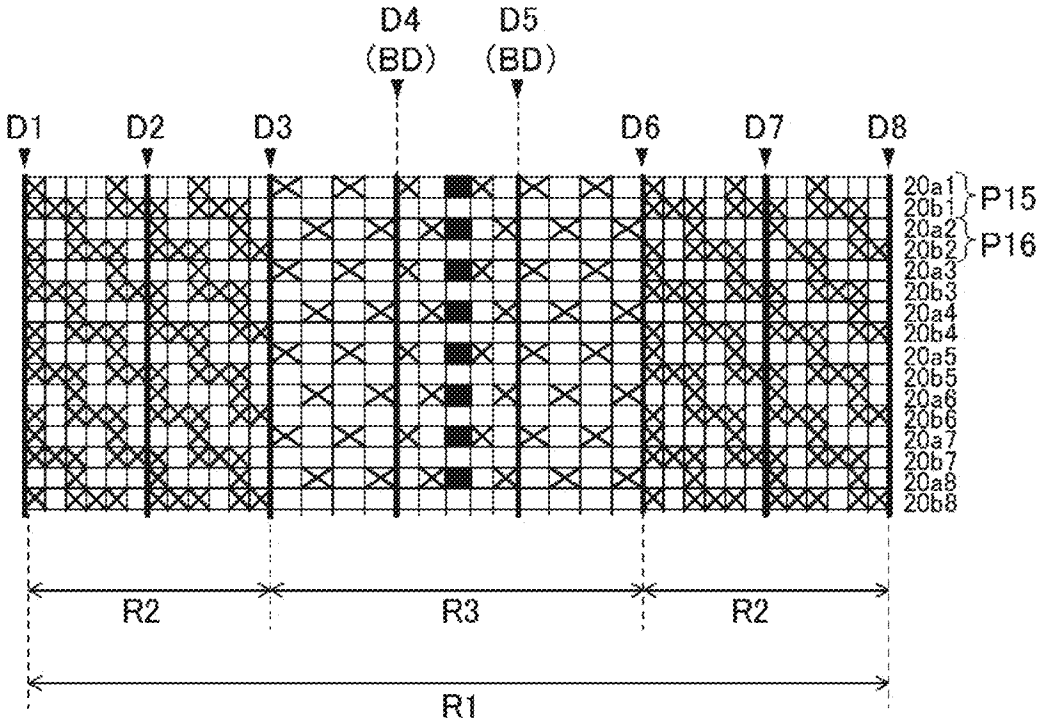
FIG. 28 is a structure diagram showing the positional relationship between a woven fabric and dents according to a seventh embodiment.

In the fifth and sixth embodiments shown in FIGS. 20 to 27, the fiber connection section R2 is also formed as a plain weave. Since the woven fabric connection section R2 is a plain weave similarly to the woven fabric placement section R3, the woven fabric connection section R2 is also light in weight as in above, and the flat thread 3 can be hidden. Since the lengths of floated portions of the threads are small, the texture is tight and can be made thin, and thus, durability (abrasion resistance) can be enhanced. In addition, since both the woven fabric placement section R3 and the woven fabric connection section R2 are plain weaves, and the flat thread is partially fixed with the weft threads, plain weaves having different mesh sizes continue. Since the same structure as shown in FIGS. 24 and 27 continues, compared with a case where different structures are combined, design/physical property can be made more uniform.

Figure 29A:
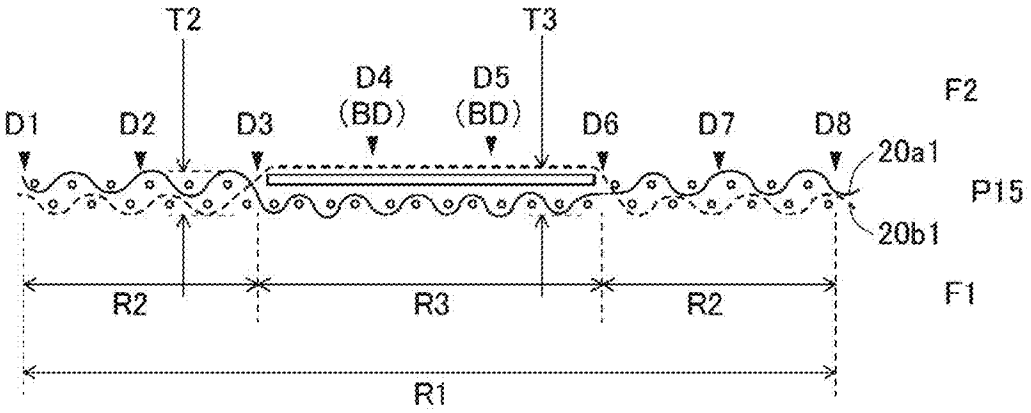
Figure 29B:
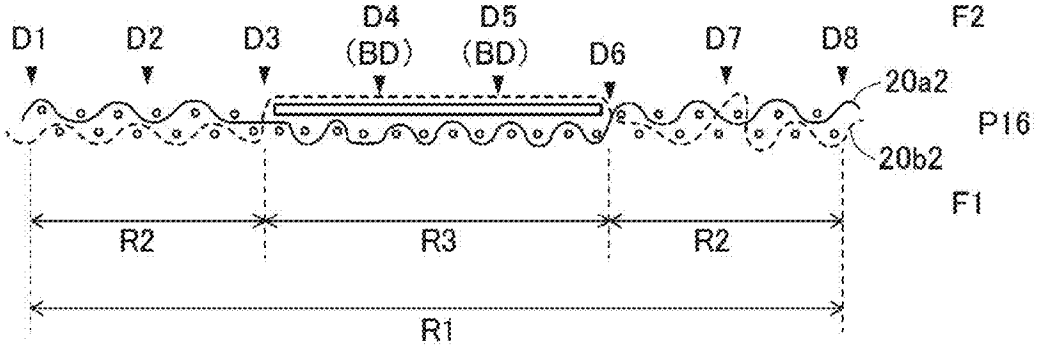
Figure 30:
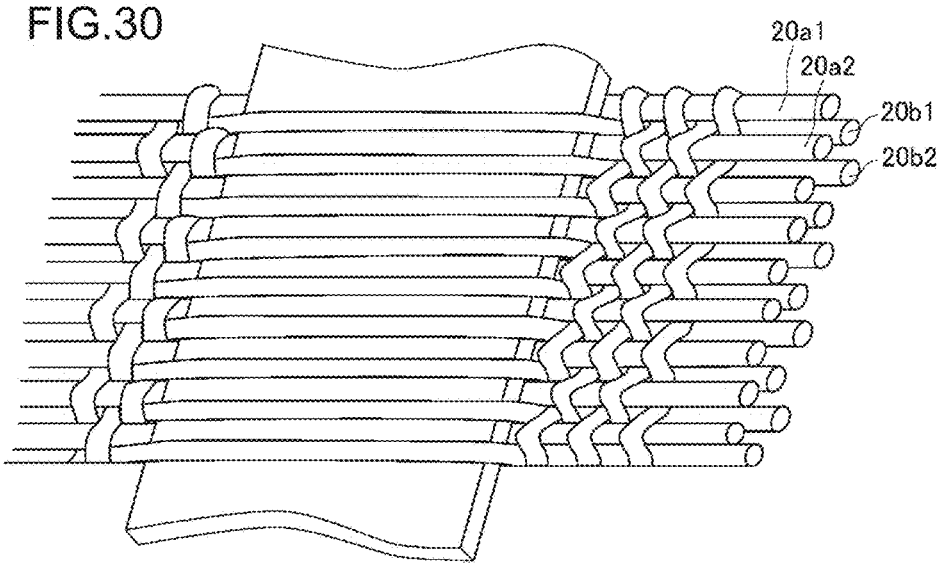
FIG. 30 is a perspective view from the rear face (F2) side of the woven fabric shown in FIG. 28.
Figure 31:
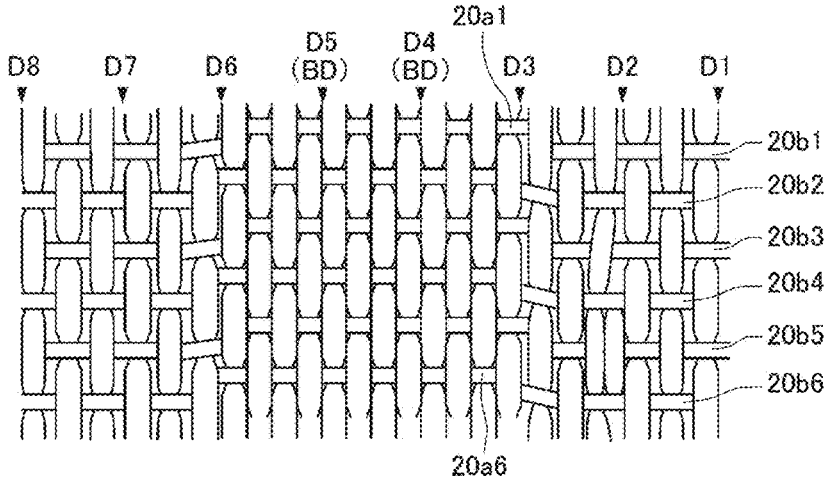
FIG. 31 is a plan view from the front face (F1) of the woven fabric shown in FIG. 28.
Figure 32:
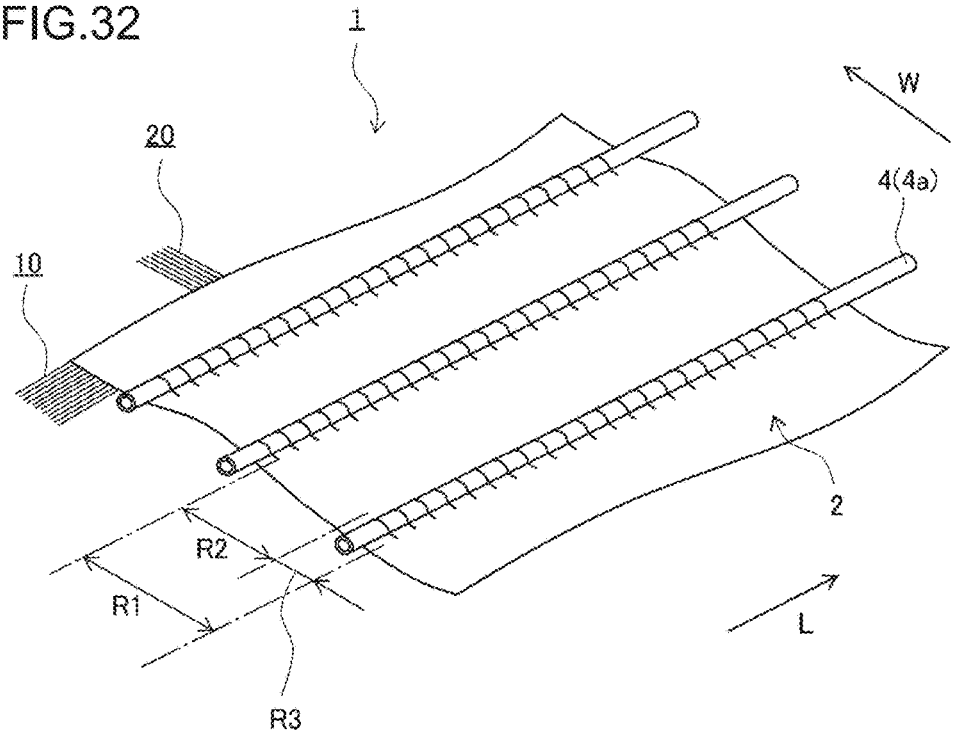
FIG. 32 is a perspective view of a woven fabric in which a functional thread is used by a method according to an eighth embodiment of the present invention.
Figure 33:
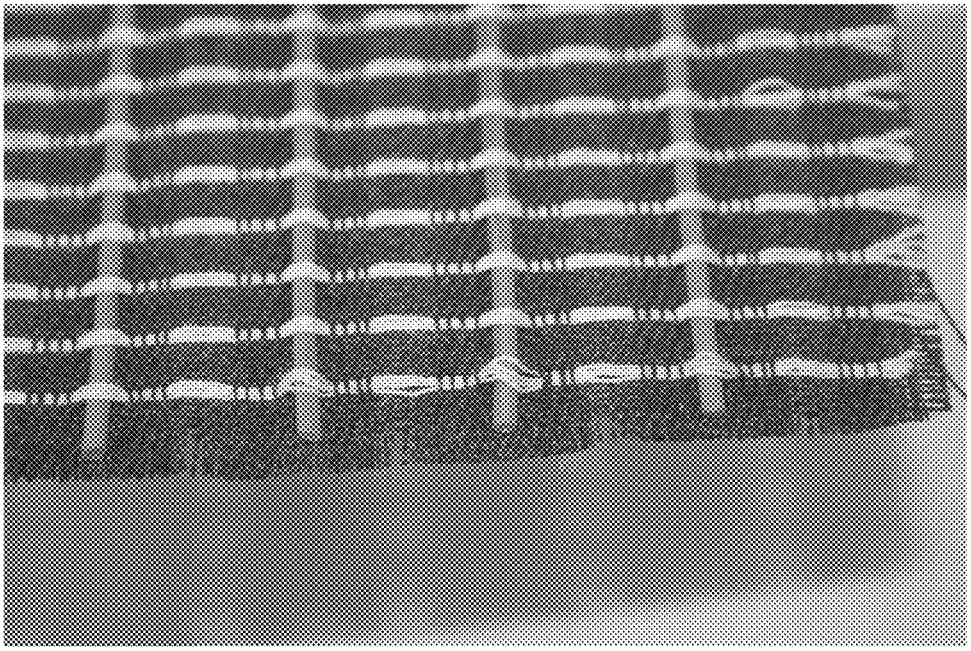
FIG. 33 is a photograph of the woven fabric shown in FIG. 32.
Figure 34:
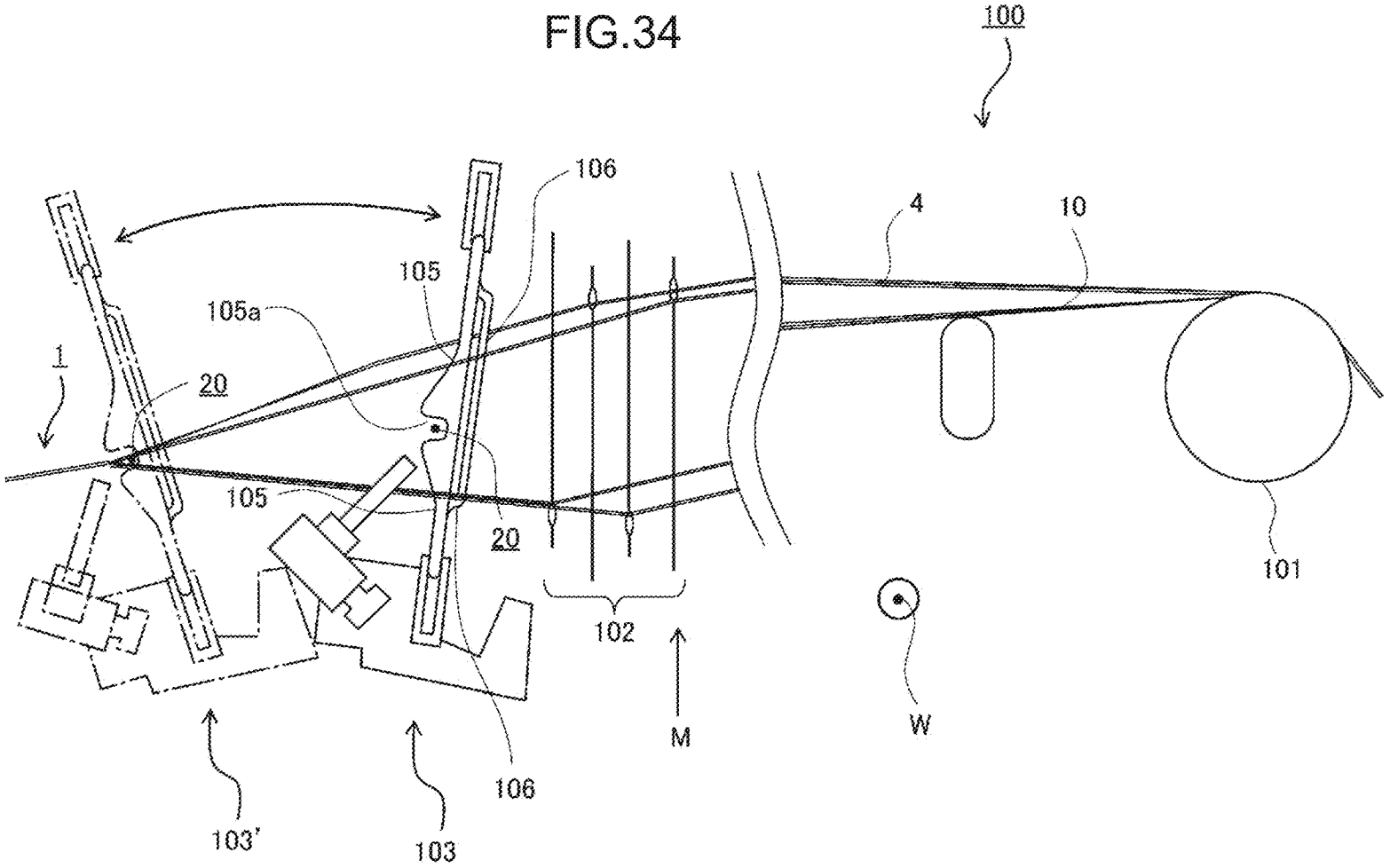
FIG. 34 is a loom according to the eighth embodiment of the present invention.

In the seventh embodiment shown in FIGS. 28 to 31, the woven fabric connection section R2 is a combination weave. According to the feature, the woven fabric placement section R3 is formed as a plain weave to be thin, has the flat thread laid thereon, and thus has an increased thickness thereof, and the woven fabric connection section R2 is a combination weave and thus has an increased thickness T2. Therefore, as shown in FIGS. 29 and 30, the thickness T2 of the woven fabric connection section R2 can be made close to a thickness T3 of the entirety of the woven fabric placement section R3 including the flat thread 3, and thus, the thickness as the entire woven fabric can be made more uniform.

In an eighth embodiment shown in FIGS. 32 to 37, the following configuration is shown. A method for manufacturing a woven fabric, the woven fabric including: fiber warp threads 10 and fiber weft threads 20, and further including functional threads 4 which are each thicker than each fiber warp thread 10, which are less likely to bend, and which have a predetermined function, the method including: causing functional threads 4 pass through healds 102 intermittently with respect to a plurality of the fiber warp threads; intermittently cutting off adjacent two dents 14 among the dents 14 forming the reed 103, at a plurality of positions; disposing obtained adjacent two thin plates so as to be shifted to the warp thread 10 winding side, at each position where the two thin plates have been cut off; causing each functional thread 4 to pass between the two thin plates; interweaving each fiber weft threads 20 with the fiber warp threads 10 to form a plurality of woven fabric placement sections R3 so as to be arranged in the weft direction W, each woven fabric placement section R3 being formed as a woven fabric structure and having the functional thread 4 corresponding thereto placed on the woven fabric structure; disposing the functional thread 4 on the fiber warp threads 10 in the woven fabric placement section R3; and causing a part of the fiber weft threads 20 to pass over the functional thread 4 to fix the functional thread on the woven fabric placement section R3, and a woven fabric manufactured by this method.

In the above manufacturing method, the two thin plates may be back dents 106 which form a part of the reed 103 and which are disposed so as to be shifted to the warp thread winding side. Alternatively, the two thin plates may be disposed independently of the reed 103. Also in the configuration of the 13th embodiment, the modes in the 12th embodiment and therebefore can be implemented.

Figure 36:
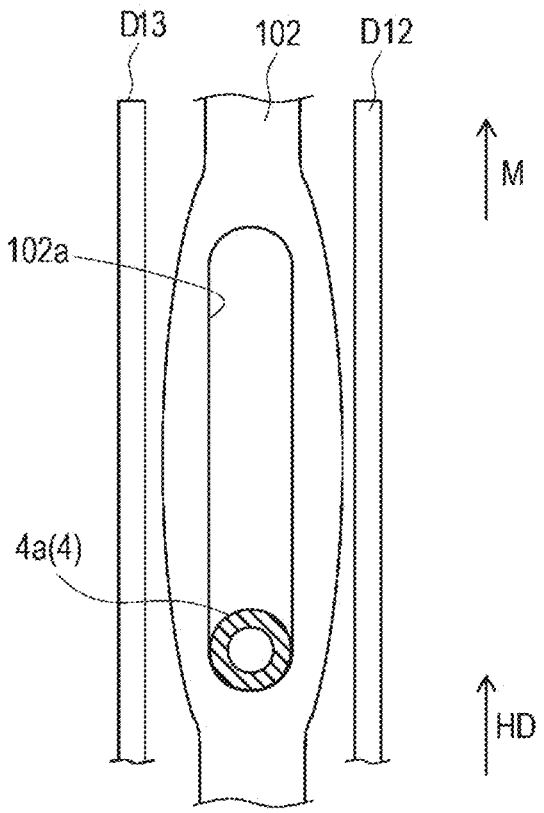
FIG. 36 is an enlarged rear view of a heald according to the eighth embodiment.
Figure 37A:
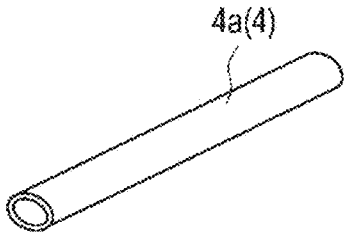
Figure 37B:
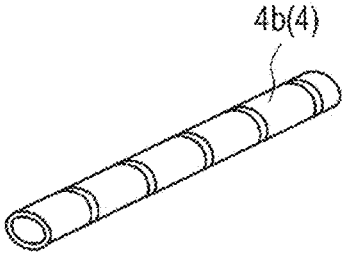
Figure 37C:
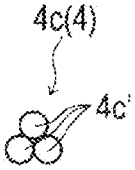
Figure 37D:
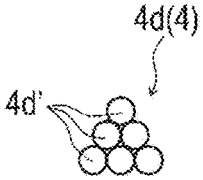
Figure 37E:
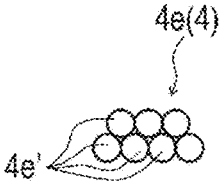
Figure 37F:
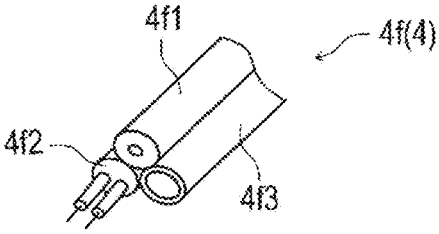

As shown in FIGS. 36 and 37(*a*), the functional thread 4 in the present embodiment is a round tube 4*a* having a hollow circular cross section, and has a predetermined function, here a function of causing liquid or gas to flow. The interval between the front end of the woven fabric fiber part 2 and the dents 105 varies every crossing of the weft thread. Ordinary fiber warp threads 10 are easy to bend, and thus, even if the interval varies, such fiber warp threads 10 will flexibly follow the change and are not trapped therebetween.

Figure 35A:
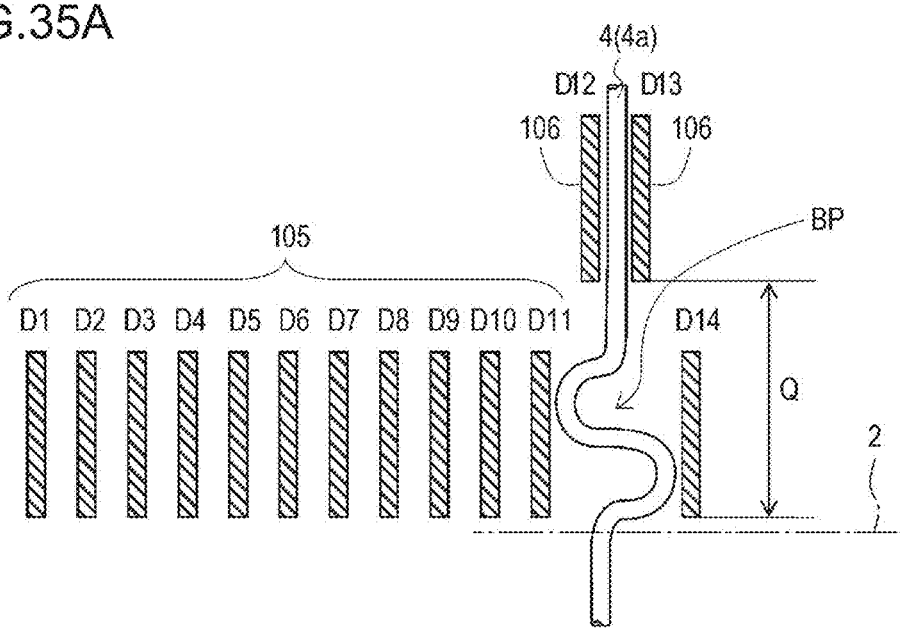
FIG. 35A is a cross-sectional view of the reed shown in FIG. 34 in the same cross section as in FIG. 4.
Figure 35B:
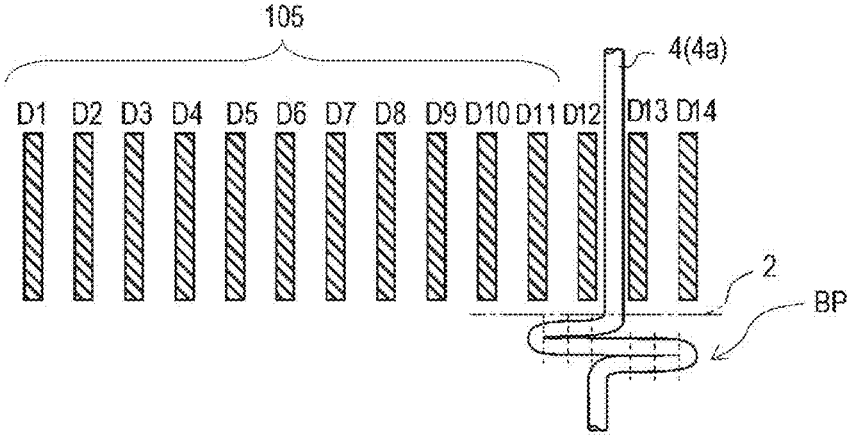
FIG. 35B shows a comparative example where back dents are not used.

However, the round tube 4*a* being the functional thread 4 is thicker than the fiber warp thread 10 and is less likely to bend. Thus, for example, as shown in FIG. 35(*b*), when the round tube 4*a* is sandwiched between the dents 105 in the vicinity of the front end of the woven fabric fiber part 2, the round tube 4*a* is less likely to deform, and once being bent, the round tube 4*a* forms a deformed congestion portion BP. This deformed congestion portion BP will remain as it is or will remain by being fixed with the fiber warp threads 10, which will damage the function of the functional thread 4.

However, in the present embodiment, as shown in FIG. 35(*a*), the back dents 106 are used in the part where the functional thread 4 is caused to pass. Accordingly, the deformed congestion portion BP is formed within the offset distance Q between the front end of the woven fabric fiber part 2 and the back dents, and is not formed on the woven fabric fiber part 2. In addition, the degree of the bending of the functional thread 4 is smaller than that in the case where the functional thread 4 is strongly sandwiched between the dents 105 and the front end of the fiber woven fabric section 2, and thus, the function of the functional thread 4 is not impaired by the bending.

Modifications of the functional thread 4 will be shown in FIG. 37(*b*) and thereafter. In FIG. 37(*b*), a spiral round tube 4*b* is created by winding resin or the like in a spiral shape. Since wires and the like can be taken out from the spiral portion, the spiral round tube 4*b* is suitable for clothes for wearable computing and other wearable media. FIGS. 37(*c*) to 37(*e*) show examples in which a plurality of unit functional threads 4*c*', 4*d*', 4*e*' are combined to form the functional thread 4 as a composite functional thread 4*c* to 4*e*. Each unit functional thread 4*c*', 4*d*', 4*e*' may be a tube or a solid member, and in the case of a solid member, an optical fiber or the like corresponds to the solid member, for example. A composite functional thread 4*f* shown in FIG. 37(*f*) is an applied example of the composite functional thread 4*c*. For example, an optical fiber 4*f*1, an electric cable 4*f*2 having a pair of conductors, and a round tube 4*f*3 are used.

Figure 38:
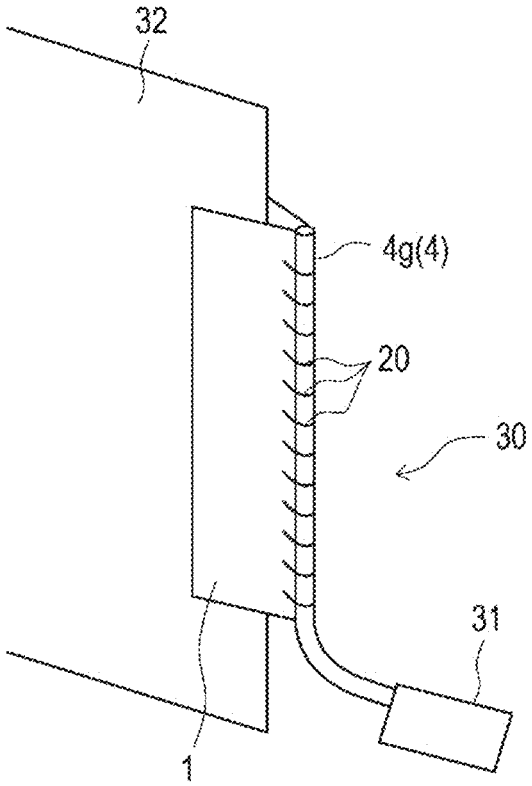
FIG. 38 is a perspective view of a carpet according to a ninth embodiment.

In a ninth embodiment shown in FIG. 38, for forming an optical module 30, an optical fiber 4*g* as the functional thread 4 is interwoven in the woven fabric fiber part 2. The woven fabric fiber part 2 is bent at the part where the optical fiber 4*g* has been interwoven, and the optical module 30 is mounted to the edge of a carpet 32. Optical modules 30 may be obtained by cutting the woven fabric fiber parts 2 from the woven fabric 1 having a plurality of functional threads 4 interwoven, such that each woven fabric fiber part 2 includes a functional thread 4.

Figure 39A:
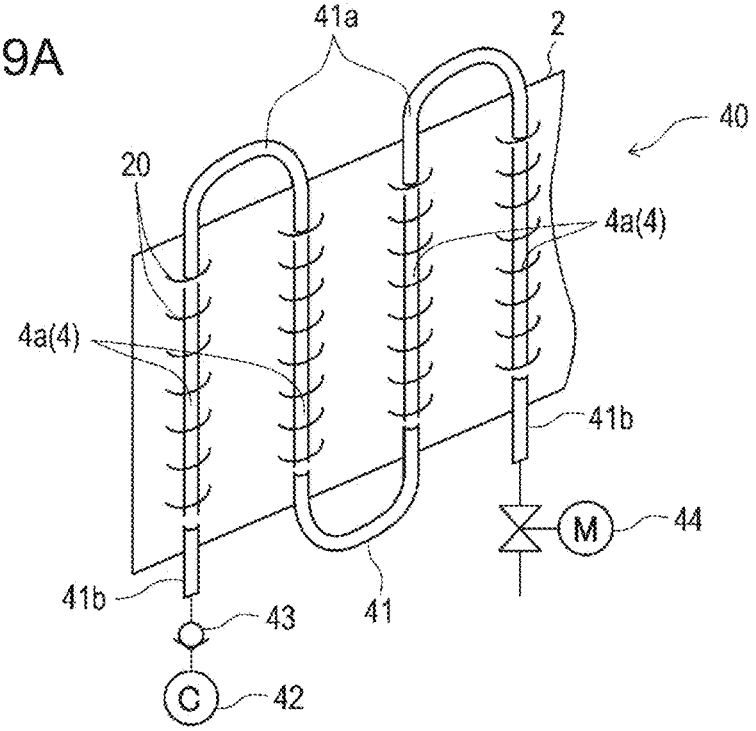
FIGS. 39A and 39B show an example of an artificial muscle according to a tenth embodiment, in which DIF. 39A is a development of a muscle module.
Figure 39B:
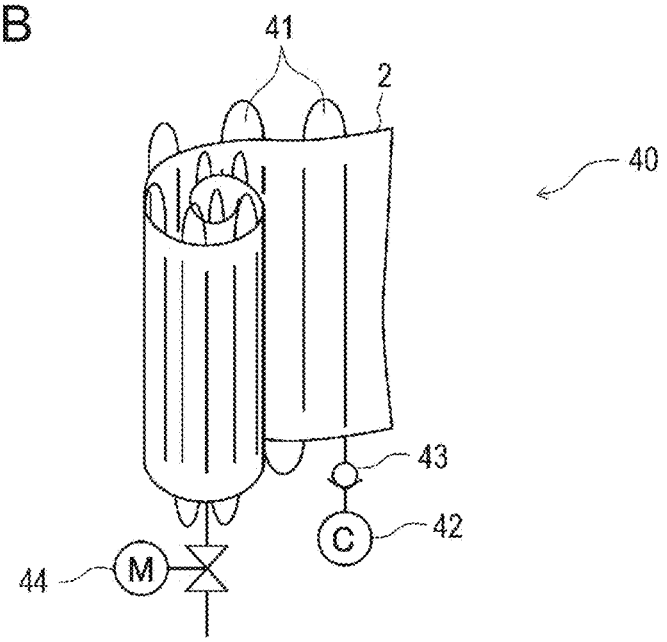
Figure 40A:
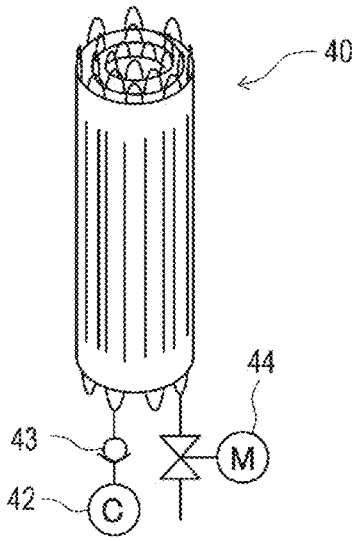
Figure 40B:
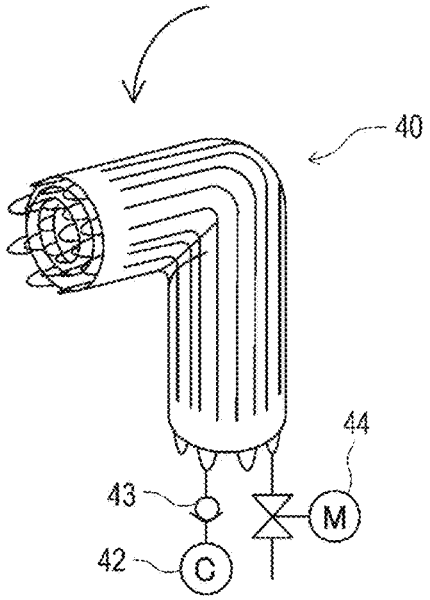

In a tenth embodiment shown in FIGS. 39 and 40, the present invention is implemented as an actuator 40. In this embodiment, as shown in FIG. 39(*a*), end extension tubes 41*b* and relay tubes 41*a* which each alternately connect ends of a plurality of round tubes 4 interwoven in the woven fabric fiber part 2 are connected. One of the end extension tubes 41*b* is provided with a compressor 42 and a check valve 43, and the other of the end extension tubes 41*b* has a globe valve 44 connected thereto.

The woven fabric fiber part 2 is rolled as shown in FIG. 39(*b*), to form the actuator 40 having a cylindrical shape as shown in FIG. 40(*a*). When the compressor 42 is stopped and the globe valve 44 is opened, the actuator 40 bends or is reduced in length under pressure as shown in FIG. 40(*b*). Then, when the globe valve 44 is closed and the compressor 42 is caused to operate, the actuator 40 is extended and bending thereof is relieved as shown in FIG. 40(*a*). The fluid may be gas such as air. Alternatively, a reserve tank and a return channel may be provided between the globe valve 44 and the compressor 42, and a fluid such as water or oil may be used.

Figure 41:
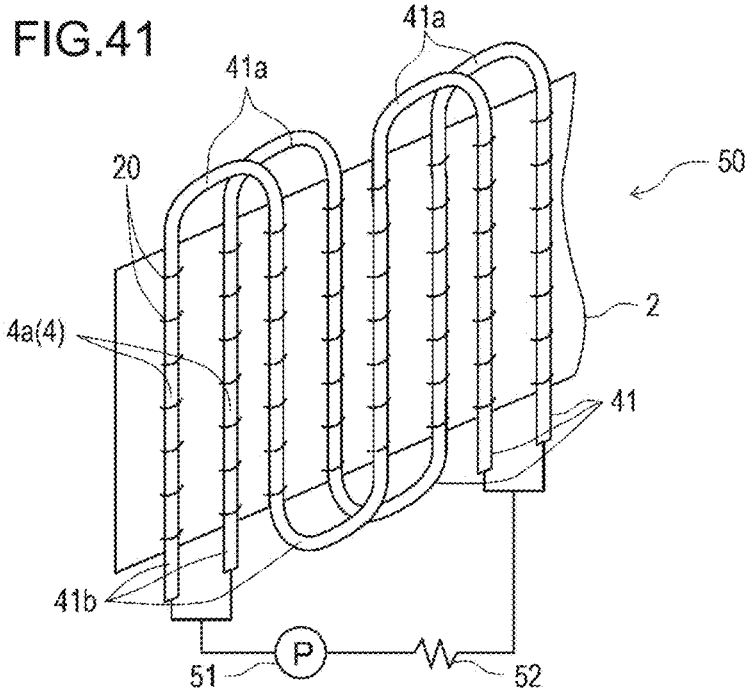
FIG. 41 is a developed perspective view of a cooling device according to an 11th embodiment.
Figure 42:
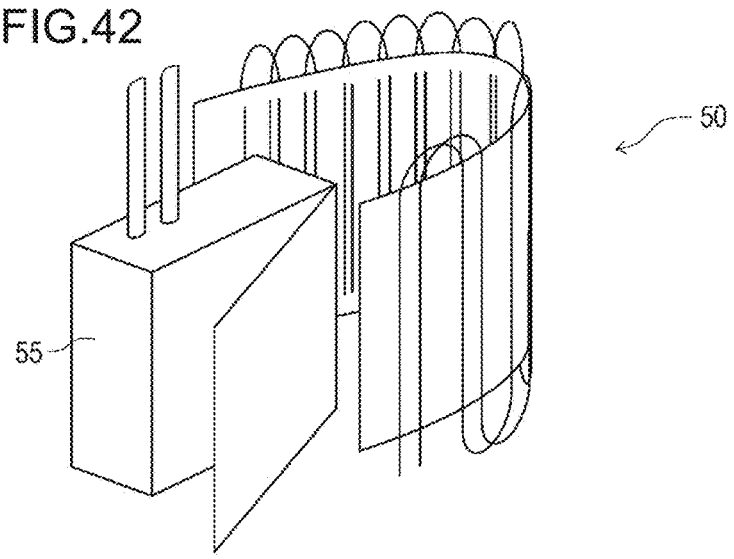
FIG. 42 is a perspective view showing a state where the cooling device shown in FIG. 41 is set.

In an 11th embodiment shown in FIGS. 41 and 42, the present invention is implemented as a cooling module 50. With respect to the cooling module 50, the woven fabric fiber part 2, the round tube 4*a*, and the relay tube 41*a*, and the end extension tube 41*b* are the same as those in the tenth embodiment above. However, the 11th embodiment is different from the tenth embodiment in that a pump 51 and a heat exchanger 52 are provided between the end extension tubes 41*b* and a refrigerant is caused to flow. For example, the cooling module 50 is placed over the surface of a distribution box 55 which generates heat, to be used to cool the distribution box 55.

Figure 43:
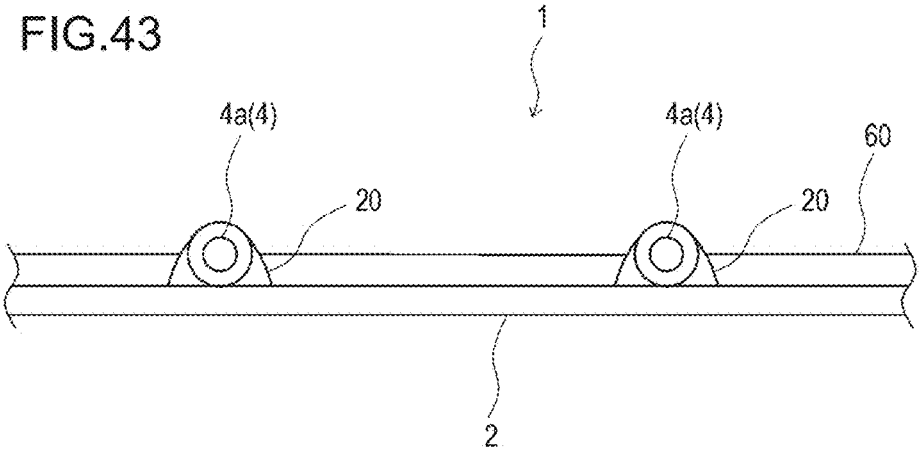
FIG. 43 is a cross-sectional view of a woven fabric according to a 12th embodiment.
Figure 44A:
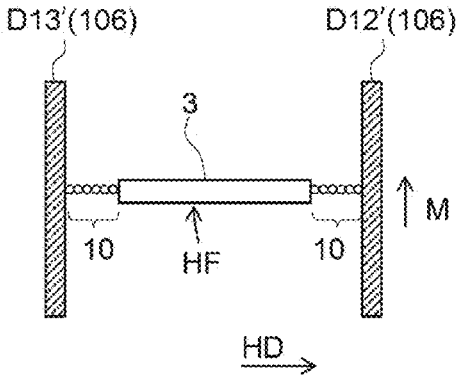
FIG. 44A is an enlarged longitudinal cross-sectional view of the vicinity of the reed in the case where the interval between dents are increased and the flat face of the flat thread is horizontally disposed.
Figure 44B:
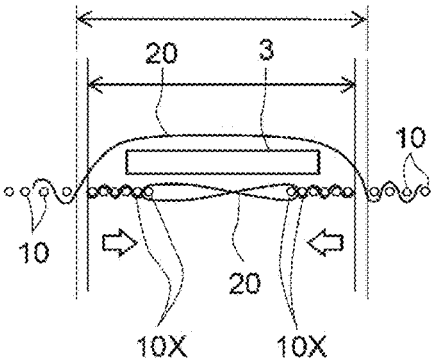
FIG. 44B is an enlarged longitudinal cross-sectional view of a woven fabric that is woven in that case.
Figure 44C:
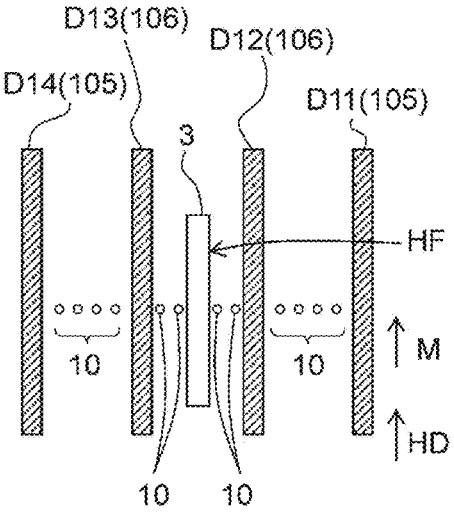
FIG. 44C is an enlarged longitudinal cross-sectional view of the vicinity of the reed in the case where the flat face of the flat thread is vertically disposed while the interval between dents at the position corresponding to FIG. 44A is made equal the interval between other dents.
Figure 44D:
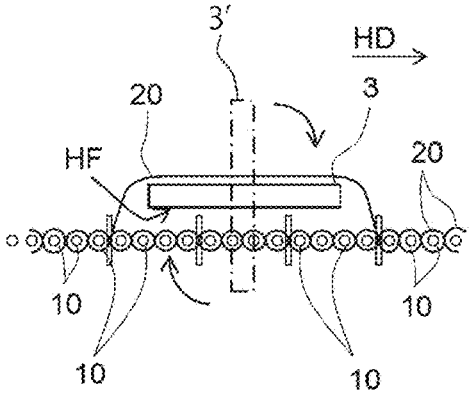
FIG. 44D is an enlarged longitudinal cross-sectional view of a woven fabric that is woven in that case.

In a 12th embodiment shown in FIG. 43, the woven fabric fiber part 2 is coated with a resin layer 60 on the functional thread 4 side. The functional threads 4 are further rigidly fixed on the woven fabric fiber part 2 by the resin layer 60. It is understood that the flat threads 3 may be used instead of the functional threads 4.

Figure 45A:
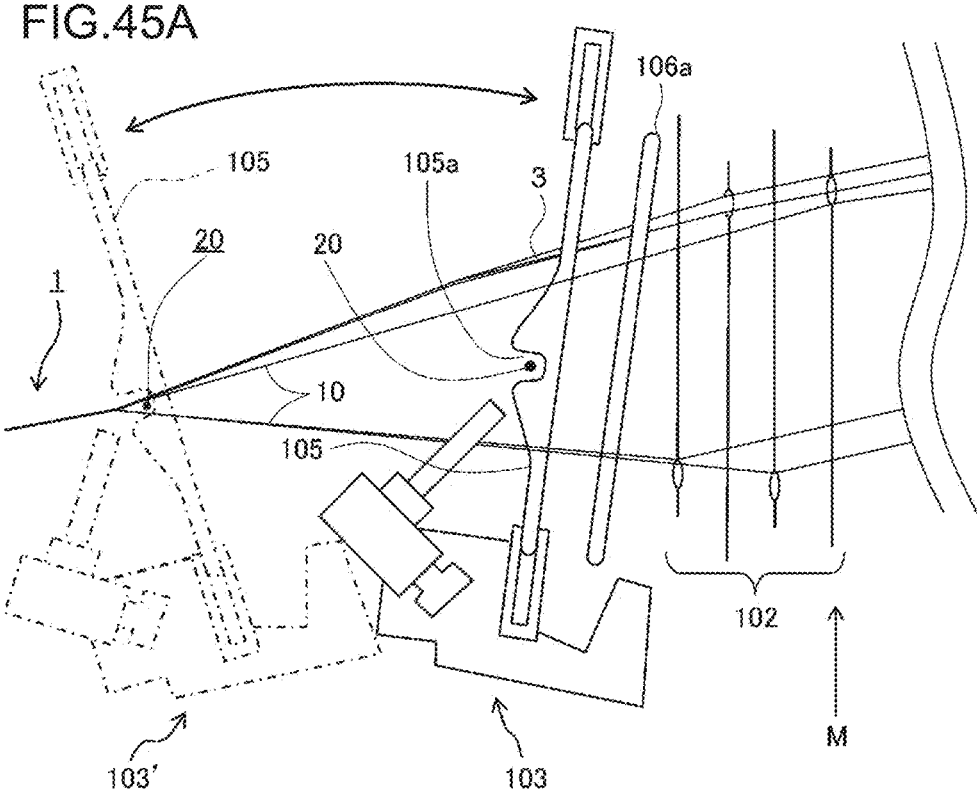
FIG. 45A is a drawing corresponding to FIG. 3 in a 13th embodiment.
Figure 45B:
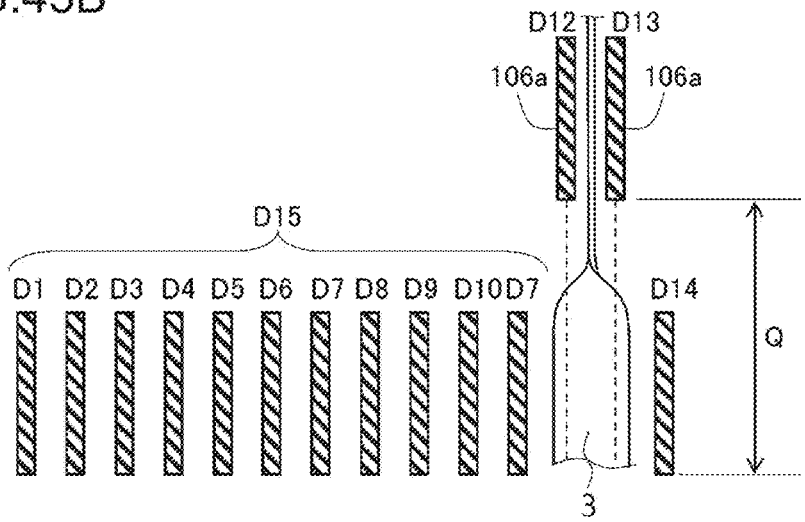
FIG. 45B is a drawing corresponding to FIG. 5 in the case of FIG. 45A.

In a 13th embodiment shown in FIG. 45, adjacent two dents 105 among dents 105 forming the reed 103 are intermittently cut off at a plurality of positions; obtained adjacent two thin plates 106*a*, 106*a* are disposed so as to be shifted to the warp thread winding side, at each position where the two thin plates 106*a*, 106*a* have been cut off; and the flat thread 3 is caused to pass between the two thin plates 106*a*. By being fixed, the two thin plates 106*a* are disposed independently of the reed 103. With this configuration, the distance Q between the thin plates 106*a* and the dents 105 can be increased compared with that in the first embodiment, when the reed 103 is shifted to the woven fabric side.

The part to be cut off and shifted is the part that corresponds to the back dents D12 and D13 above, and is cyclically provided. Although the thin plates 106*a* are not back dents, the thin plates 106*a* are denoted by the same reference character for easy understanding. The thin plates 106*a* may be completely fixed so as not to move, but may move in conjunction with the reed 103.

The above embodiments may be combined together to be implemented. In particular, instead of the flat thread 3, the functional thread 4 may be used.

INDUSTRIAL APPLICABILITY

The present invention can be used as a woven fabric whose shape can be fixed by plastic deformation of the flat thread. Further, when the flat thread has elasticity, the woven fabric can be caused to take a certain shape again. In addition, the flat thread may have a various functions. For example, if a hollow tube is used as the flat thread, it is also possible to cause gas to flow in the tube, or to cause fluid to flow and be held therein. If an electric wire or an optical cable is used as the flat thread, the woven fabric can also be used as a part of an electronic device. By using a hard resin as the flat thread, the woven fabric can have a protective function.

The woven fabric can be subjected to the same processing that is performed on general woven fabrics. For example, the woven fabric can be subjected to thermal processing, pasting, resin processing, sputtering, dyeing, plating, and the like.

DESCRIPTION OF REFERENCE CHARACTERS

1 woven fabric
2 woven fabric fiber part
3 flat thread
4 functional thread
4*a* round tube
4*b* spiral round tube
4*c*, 4*d*, 4*e*, 4*f* composite functional thread
4*f*1 optical fiber
4*f*2 electric cable
4*f*3 round tube
4*g* optical fiber
4*c*', 4*d*', 4*e*' a plurality of unit functional threads
10 fiber warp thread
20 fiber weft thread
20*a* first weft thread
20*b* second weft thread
30 optical module
40 actuator
41*a* relay tube
41*b* end extension tube
42 compressor
43 check valve
44 globe valve
50 cooling module
51 pump
52 heat exchanger
55 distribution box
60 resin layer
100 loom
101 roller
102 heald
102*a* heald hole
103 reed
105 dent
105*a* groove
106 back dent
106*a* thin plate
D1 to 11, 14 dent
D12, 13 back dent
P1 to 10 first to tenth portions
R1 woven fabric base section
R2 woven fabric connection section
R3 woven fabric placement section
R4 woven fabric covering section
W weft direction
L warp direction
M heald moving direction
Q offset distance
HF flat face
HD longitudinal direction in transverse plane
BP deformed congestion portion

The invention claimed is:

1. A method for manufacturing a woven fabric, the woven fabric including fiber warp threads and fiber weft threads, and further including flat threads each wider than each fiber warp thread, the method comprising:

causing the flat threads to pass through healds intermittently with respect to a plurality of the fiber warp threads;

causing each flat thread to pass through a hole of the heald corresponding thereto, the hole being long in a heald moving direction, thereby to orient a longitudinal direction in transverse plane of the flat thread along the heald moving direction;

interweaving the fiber weft threads with the fiber warp threads to form a plurality of woven fabric placement sections so as to be arranged in a weft direction, each woven fabric placement section being formed as a woven fabric structure and having the flat thread corresponding thereto placed on the woven fabric structure;

disposing a flat face of the flat thread on the fiber warp threads in the woven fabric placement section so as to face the fiber warp threads; and causing a part of the fiber weft threads to pass over the flat thread, to fix the flat thread on the woven fabric placement section.

2. A method for manufacturing a woven fabric, the woven fabric including fiber warp threads and fiber weft threads, and further including flat threads each wider than each fiber warp thread, the method comprising:

causing the flat threads to pass through healds intermittently with respect to a plurality of the fiber warp threads;

causing each flat thread to pass through a hole of the heald corresponding thereto, the hole being long in a heald moving direction, thereby to orient a longitudinal direction in transverse plane of the flat thread along the heald moving direction;

interweaving the fiber weft threads with the fiber warp threads to form a plurality of woven fabric placement sections so as to be arranged in a weft direction, each woven fabric placement section being formed as a woven fabric structure and having the flat thread corresponding thereto placed on the woven fabric structure;

disposing a flat face of the flat thread on the fiber warp threads in the woven fabric placement section so as to face the fiber warp threads;

disposing a part of the fiber warp threads on the flat thread; and interweaving a part of the fiber weft threads with a part of the fiber warp threads to form a woven fabric covering section as the woven fabric structure, and fixing the flat thread on the woven fabric placement section by means of the woven fabric covering section.

3. The method for manufacturing the woven fabric according to claim 1, comprising:

intermittently cutting off adjacent two dents among dents forming a reed, at a plurality of positions;

disposing obtained adjacent two thin plates so as to be shifted to a warp thread winding side, at each position where the two thin plates have been cut off; and causing the flat thread to pass between the two thin plates.

4. The method for manufacturing the woven fabric according to claim 2, comprising:

intermittently cutting off adjacent two dents among dents forming a reed, at a plurality of positions;

disposing obtained adjacent two thin plates so as to be shifted to a warp thread winding side, at each position where the two thin plates have been cut off; and causing the flat thread to pass between the two thin plates.

5. The method for manufacturing the woven fabric according to claim 3, wherein the two thin plates are back dents which form a part of the reed and which are disposed so as to be shifted to the warp thread winding side.

6. The method for manufacturing the woven fabric according to claim 4, wherein the two thin plates are back dents which form a part of the reed and which are disposed so as to be shifted to the warp thread winding side.

7. The method for manufacturing the woven fabric according to claim 3, wherein the two thin plates are disposed independently of the reed.

8. The method for manufacturing the woven fabric according to claim 4, wherein the two thin plates are disposed independently of the reed.

9. A woven fabric comprising:

fiber warp threads;

fiber weft threads;

flat threads; and a plurality of woven fabric placement sections arranged in a weft direction, each woven fabric placement section being formed as a woven fabric structure and having the flat thread corresponding thereto placed on the woven fabric structure by the fiber weft threads being interwoven with the fiber warp threads, wherein the flat threads are oriented along a warp direction and arranged in a weft direction, and are each disposed on the fiber warp threads with a flat face of the flat thread facing the fiber warp threads, the flat threads are one of the threads having a rectangular cross section, electric cables, optical cables, hollow threads and hollow tubes;

the woven fabric placement section is a plain weave, and among the fiber warp threads and the fiber weft threads, a part of only the fiber weft threads is caused to pass over each flat thread, to fix the flat thread on the woven fabric placement section.

10. The woven fabric according to claim 9, further comprising:

a woven fabric connection section which is woven with the fiber warp threads and the fiber weft threads, and which is disposed between the plurality of woven fabric placement sections to connect the woven fabric placement sections, wherein the woven fabric connection section is a plain weave.

11. The woven fabric according to claim 9, further comprising:

a woven fabric connection section which is woven with the fiber warp threads and the fiber weft threads, and which is disposed between the plurality of woven fabric placement sections to connect the woven fabric placement sections, wherein the woven fabric connection section is a combination weave.

12. The woven fabric according to claim 9, wherein the fiber warp threads and the fiber weft threads are each not less than 10 denier and not greater than 4000 denier.

13. The woven fabric according to claim 9, wherein the woven fabric placement section has a weft density of not less than 8 threads/inch and not greater than 500 threads/inch.

14. The woven fabric according to claim 9, wherein the flat thread is formed from any one of polyolefin, polycarbonate, polyamide, polyphenylene sulfide, polyetherimide, polyether ketone, polyamide-imide, polypropylene, and ABS.

15. The woven fabric according to claim 9, wherein the fiber warp threads and the fiber weft threads are each a natural fiber or a fiber made of synthetic resin.

16. The woven fabric manufactured by the method for manufacturing the woven fabric according to claim 1.

17. The woven fabric manufactured by the method for manufacturing the woven fabric according to claim 2.

18. The woven fabric according to claim 9, wherein the part of only the fiber weft threads is caused to pass over the flat thread to fix an entire length of the flat thread on the woven fabric placement section in an entire length of the woven fabric structure.

19. The woven fabric according to claim 9, wherein the flat face of the flat thread faces at least four warp threads.

* * * * *